US008787795B2

(12) United States Patent
Fujii et al.

(10) Patent No.: US 8,787,795 B2
(45) Date of Patent: Jul. 22, 2014

(54) IMAGE REPRODUCTION APPARATUS INCLUDING A WASTE TONER ASSEMBLY

(75) Inventors: Hirokazu Fujii, Osaka (JP); Daijiro Ueno, Osaka (JP); Hiroki Takahashi, Osaka (JP); Tatsuya Yamanaka, Osaka (JP)

(73) Assignee: Kyocera Document Solutions Inc. (JP)

( * ) Notice: Subject to any disclaimer, the term of this patent is extended or adjusted under 35 U.S.C. 154(b) by 79 days.

(21) Appl. No.: 13/337,586

(22) Filed: Dec. 27, 2011

(65) Prior Publication Data

US 2012/0163858 A1 Jun. 28, 2012

(30) Foreign Application Priority Data

Dec. 28, 2010 (JP) ..... P2010-292661
Dec. 28, 2010 (JP) ..... P2010-292662
Sep. 30, 2011 (JP) ..... P2011-216981

(51) Int. Cl.
*G03G 15/00* (2006.01)

(52) U.S. Cl.
USPC ..... 399/120

(58) Field of Classification Search
USPC ..... 399/35, 120, 116, 117, 110, 113, 114, 399/358, 360
See application file for complete search history.

(56) References Cited

U.S. PATENT DOCUMENTS

2002/0037178 A1 3/2002 Saitoh et al. ..... 399/110
2005/0260019 A1 11/2005 Arai ..... 399/360
2006/0104663 A1 5/2006 Kitozaki ..... 399/111
2007/0286649 A1* 12/2007 Kawasumi et al. ..... 399/296
2009/0097879 A1 4/2009 Nagashima ..... 399/120
2009/0269111 A1* 10/2009 Fukunaga et al. ..... 399/358

FOREIGN PATENT DOCUMENTS

| | | | |
|---|---|---|---|
| CN | 101075118 | A | 11/2007 |
| JP | 61-117584 | | 6/1986 |
| JP | 08-314348 | | 11/1996 |
| JP | 9-096998 | | 4/1997 |
| JP | 2006-139156 | | 6/2006 |
| JP | 2008-304841 | | 12/2008 |
| JP | 2009-116305 | | 5/2009 |
| JP | 2009-265382 | | 11/2009 |
| JP | 2009-271276 | | 11/2009 |
| JP | 2010-039395 | | 2/2010 |
| JP | 2010039395 | A * | 2/2010 |
| JP | 2010-060602 | | 3/2010 |
| JP | 2010-072310 | | 4/2010 |
| JP | 2010-152239 | | 7/2010 |

* cited by examiner

*Primary Examiner* — Clayton E LaBalle
*Assistant Examiner* — Victor Verbitsky
(74) *Attorney, Agent, or Firm* — Ostrolenk Faber LLP

(57) ABSTRACT

What is provided is an image formation apparatus including: an image formation part provided inside a main body so that the image formation part may be attached to the main body and detached from the main body; a plurality of opening-closing parts which may be opened and closed to attach the image formation part to the main body or detach the image formation part from the main body; and a plurality of locking parts latching each of the plurality of opening-closing parts to the main body, wherein when one of the plurality of locking parts undergoes a releasing operation, an other one of the plurality of locking parts also undergoes a releasing operation.

8 Claims, 20 Drawing Sheets

IMAGE REPRODUCTION APPARATUS INCLUDING A WASTE TONER ASSEMBLY

BACKGROUND OF THE DISCLOSURE

The present application claims priority on Japanese Patent Application No. 2010-292661, filed Dec. 28, 2010; Japanese Patent Application No. 2010-292662, filed Dec. 28, 2010; and on Japanese Patent Application No. 2011-216981, filed Sep. 30, 2011; the contents of which are incorporated herein by reference.

FIELD OF THE DISCLOSURE

The present invention relates to an image formation apparatus.

DESCRIPTION OF THE RELATED ART

An image formation apparatus of a full color type for a copying machine and a printer based on xerography is configured so that a plurality of drum type photoreceptors corresponding to each of the colors of yellow (Y), magenta (M), cyan (C), and black (BK) are provided. Further, at a peripheral surface of each photoreceptor, an electronic latent image is formed using a laser scanning unit. At the same time, at a peripheral surface of each photoreceptor, a toner image of each color is respectively formed by a toner of each color that is supplied. The toner image of each color that was formed on the peripheral surface of each photoreceptor is superimposed and copied in series to a transfer belt. This transfer belt includes an endless belt which is rotated and driven. In this way, a color image is formed on the transfer belt. Next, the color image formed on the transfer belt is transferred to a recording medium such as a paper and the like. Thereafter, the color image undergoes a fixing operation by being pressurized and heated by a fixing apparatus.

An image formation part is configured mainly by the photoreceptor described above. This image formation part is attached so that the position of the image formation part is set by a retainer (position determination part). The retainer is provided inside a main body via a locking part so that the retainer may be detached freely. The image formation part is also configured so that it may be pulled out from the main body during maintenance and inspection. In other words, the image formation part is configured that the image formation part may be pulled out from the main body during maintenance and inspection by unlocking the retainer.

According to a process of the image formation, even when a toner image formed on a photoreceptor is transferred onto a transfer belt, a portion of the toner remains on the photoreceptor. Further, even when a color image formed on the transfer belt is transferred to a recording medium, a portion of the toner remains on the transfer belt. A cleaner is provided on both the photoreceptor and an intermediate transfer belt. The cleaner removes the remaining toner from a peripheral surface. The cleaner removes toner from the peripheral surface of the photoreceptor and the transfer belt with a cleaning blade and the like. The removed toner is transported by a screw conveyer. The cleaner is configured so that the removed toner is transported to a waste toner bottle via a waste toner assembly and that the removed toner is collected by the waste toner bottle. When the waste toner assembly is used for a long time, there is a possibility that toner attaches to a wall surface surrounding a screw conveyer, thereby impairing the transportation capability of the toner. Further, it is preferable that the waste toner bottle be exchanged as necessary during maintenance and inspection of the image formation part.

According to such an image formation apparatus, units assembled in the main body other than the retainer of the image formation unit, such as a waste toner assembly, is also provided via a locking part so that the units may be attached and detached freely. Therefore, during maintenance and inspection of the image formation apparatus, the locking part of each unit has to be unlocked. In this way, there is a problem in that the operability during maintenance and inspection is substandard.

Further, a waste toner bottle is provided to the main body so that the toner bottle may be attached to and detached from the main body freely. This waste toner bottle is provided using a small amount of space inside the apparatus. As a result, considering the relationship with the waste toner assembly, a configuration is made so that the waste toner assembly is opened and closed after a waste toner bottle is detached. However, when the waste toner assembly is opened before the waste toner bottle is detached from the main body, the waste toner assembly might be twisted by coming in contact with the waste toner bottle, thereby damaging the waste toner assembly.

SUMMARY OF THE DISCLOSURE

In order to achieve the above object, the present disclosure employs the following.

Namely, an image formation apparatus according to an aspect of the present invention includes, an image formation part provided inside a main body so that the image formation part may be attached to the main body and detached from the main body; a plurality of opening-closing parts which may be opened and closed to attach the image formation part to the main body or detach the image formation part from the main body; and a plurality of locking parts latching each of the plurality of opening-closing parts to the main body. Here, when one of the plurality of locking parts undergoes a releasing operation, an other one of the plurality of locking parts also undergoes a releasing operation.

BRIEF DESCRIPTION OF THE DRAWINGS

FIG. 2 shows a condition in which a front cover of the copying machine is opened, and a waste toner bottle is attached to a main body.

FIG. 3 shows a condition in which a waste toner bottle is detached from a main body, a front cover is opened, and a waste toner assembly is closed.

FIG. 4 shows a condition in which a waste toner bottle is detached from a main body, a front cover is opened, and a waste toner assembly is opened.

FIG. 5 shows a condition in which a waste toner bottle is detached from a main body, a front cover is opened, a waste toner assembly is opened, and a retainer is opened.

FIG. 8A is a planar view of an image formation apparatus according to the above embodiment seen from above.

FIG. 8B is a cross sectional view of FIG. 7A along line X-X.

FIG. 7A is a view from a frontal side.

FIG. 9B is a view from a frontal side.

DETAILED DESCRIPTION OF THE PREFERRED EMBODIMENTS

Hereinafter, an image formation apparatus according to a first embodiment of the present disclosure is described with reference to the attached diagrams. Incidentally, in the following diagrams, the scale of each component is varied as appropriate so that each component may be large enough to be recognized. Further, in the following description, a copying machine based on xerography is given as an example of an image formation apparatus according to the present disclosure.

Figure 1:
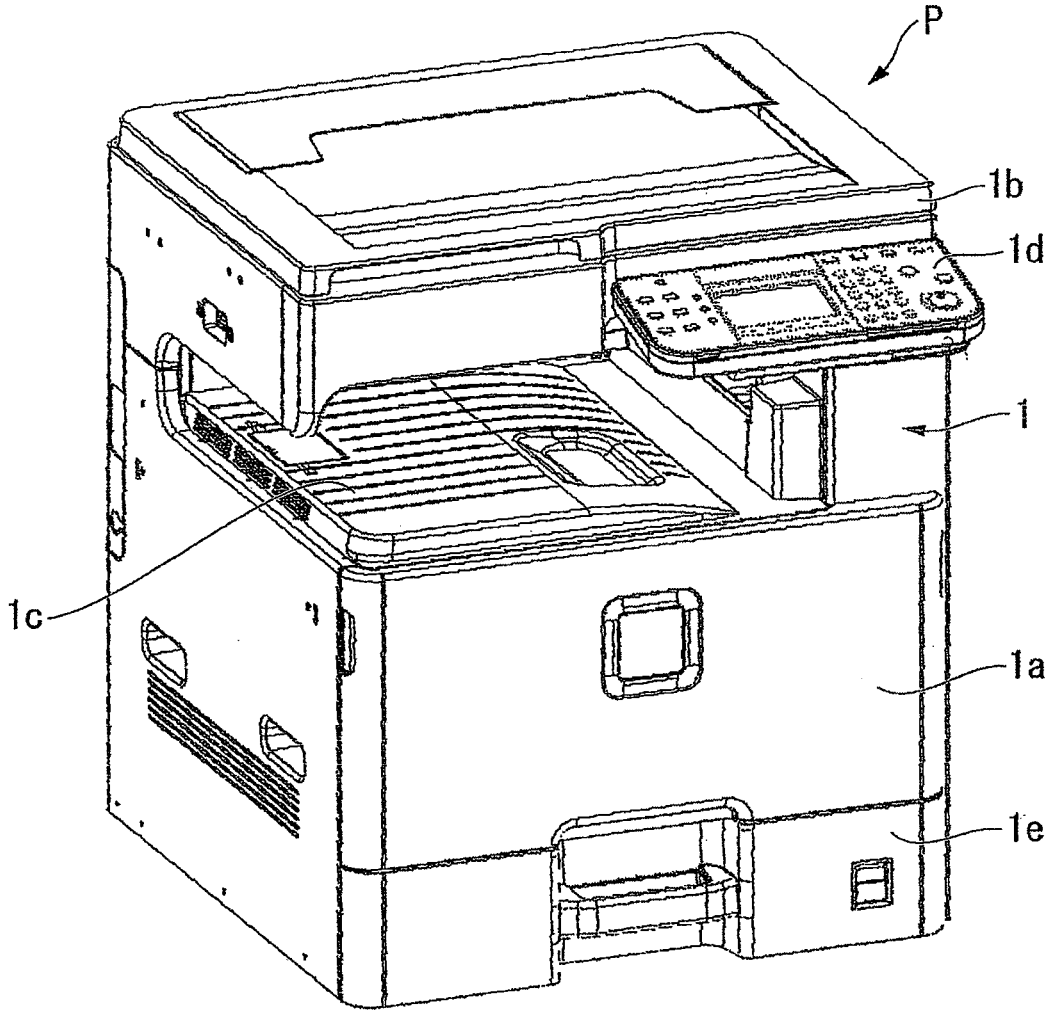
FIG. 1 is a perspective view of a copying machine applied with an image formation apparatus according to a first embodiment of the present disclosure. The copying machine is seen from a front.

FIG. 1 is a perspective view of a copying machine P seen from a frontal side. A front cover 1*a* is provided at a central part of a frontal side of a main body 1 of this copying machine P. As shown by an arrow K in FIG. 2, the front cover 1*a* is configured so that an upper part side of the front cover 1*a* may rotate toward a frontal side with a lower part side being a central axis of rotation. In this way, a central part of a front surface of the main body 1 may be exposed. Further, a document reading part 1*b* is provided at an upper part of the main body 1 of the copying machine P. A paper ejection tray 1*c* is provided at a lower side of the document reading part 1*b*. An operation part 1*d* is provided at a right side of a front surface of an upper part of the main body 1. A user may make inputs and operate the operation part 1*d*. A paper feeding tray 1*e* is provided at a lower part of the main body 1.

Hereafter, a description is provided with reference to FIGS. 2 to 5. FIGS. 2 to 5 show a condition in which a front cover 1*a* is opened.

A waste toner bottle B and a waste toner assembly 10 are provided at a central part of a front surface of the main body 1 of the copying machine P corresponding to an inner side of the front cover 1*a*. The waste toner assembly 10 corresponds to an "opening-closing part" according to the present disclosure.

A retainer R is provided at a inner side of the waste toner assembly 10. The retainer R corresponds to an "opening-closing part" according to the present disclosure. This retainer R is described later.

Figure 5:
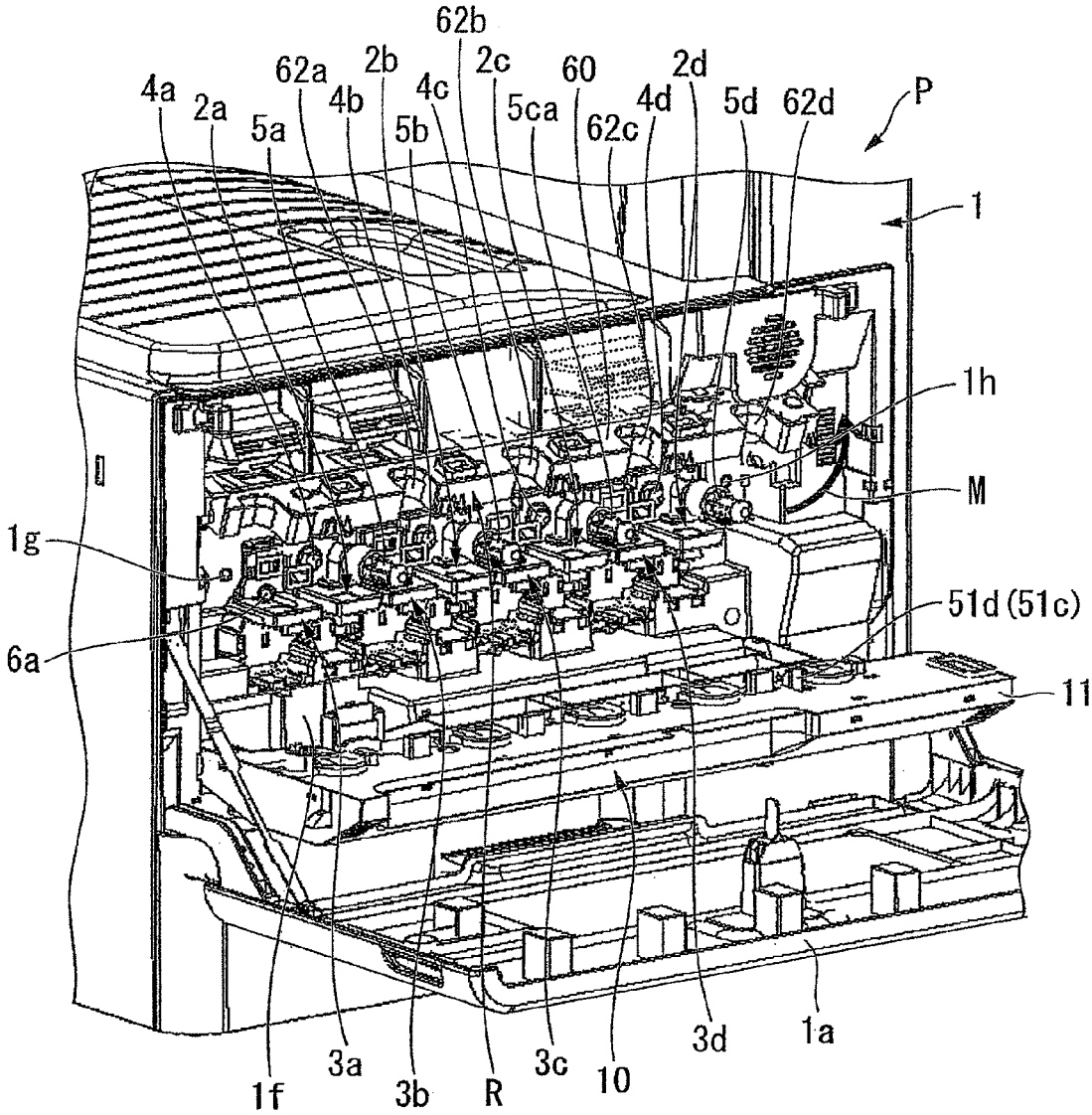
FIG. 5 is a perspective view of a copying machine applied with an image formation apparatus according to the above embodiment.

As shown in FIG. 5, an image formation part is placed at a deep inner side of the waste toner assembly 10 and the retainer R. As a part of this image formation part, photoreceptor units 2*a*-2*d* corresponding to a toner of each color and developing units 3*a*-3*d* are stored. Each of the photoreceptor units 2*a*-2*d* and the developing units 3*a*-3*d* are stored so that each of them may be attached and detached by pulling out each of them from the main body 1 toward a front side. Further, axial parts 4*a*-4*d* of the photoreceptor and ejection openings 5*a*-5*d* of the waste toner are protruding toward the frontal side from the photoreceptor units 2*a*-2*d*. Position determining holes 6*a*-6*d* are formed at the developing units 3*a*-3*d*. In FIG. 5, only element 5*a* can been seen. Position determining parts are provided at the retainer R. The position determining parts are latched with the axial parts 4*a*-4*d* and the position determining holes 6*a*-6*d*. In this way, the position determining parts determines the positions of end sides of the developing units 3*a*-3*d* and the photoreceptor units 2*a*-2*d* with respect to the main body 1. Other end sides of the developing units 3*a*-3*d* and the photoreceptor units 2*a*-2*d* are not diagrammed. However, a positions of the other end sides of the developing units 3*a*-3*d* and the photoreceptor unit 2*a*-2*d* are also determined by latching with latching parts formed at a deep inner side of the main body 1.

Figure 2:
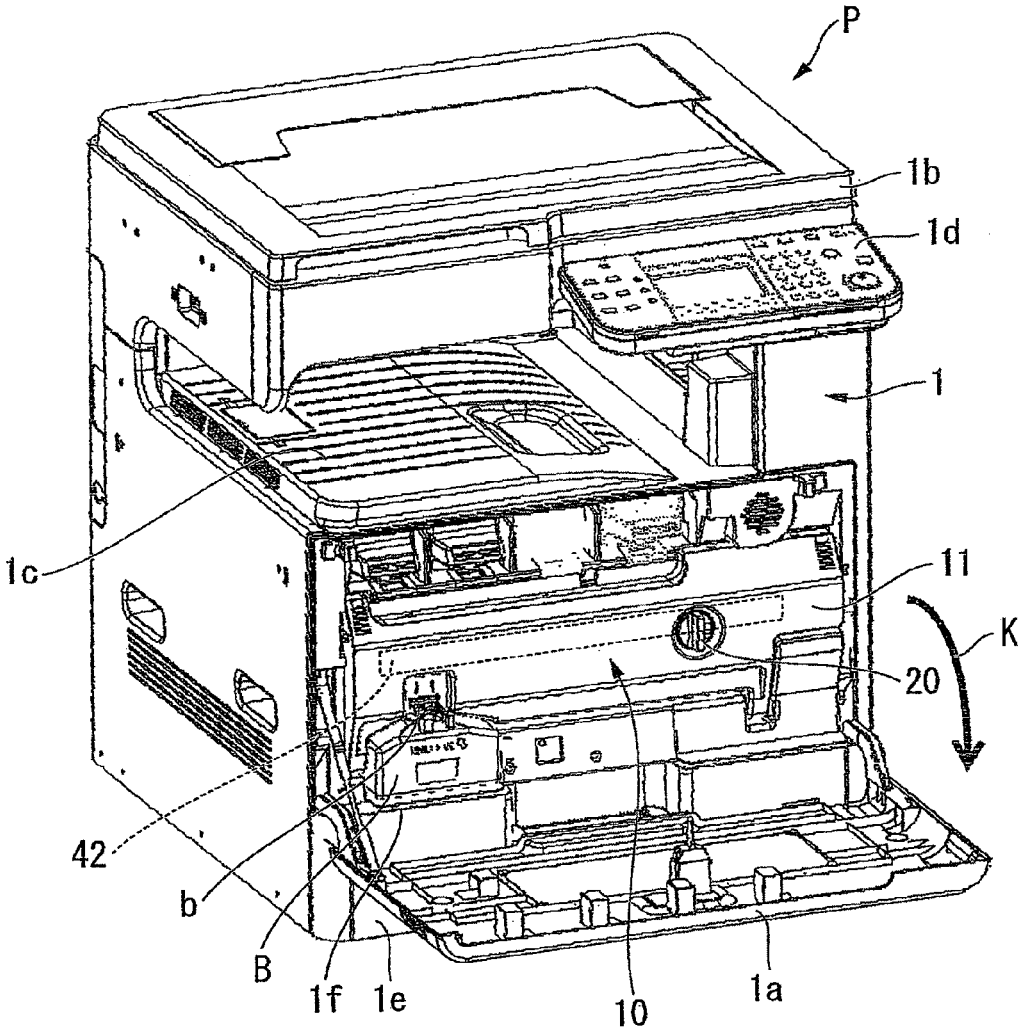
FIG. 2 is a perspective view of a copying machine applied with an image formation apparatus according to the above embodiment.
Figure 3:
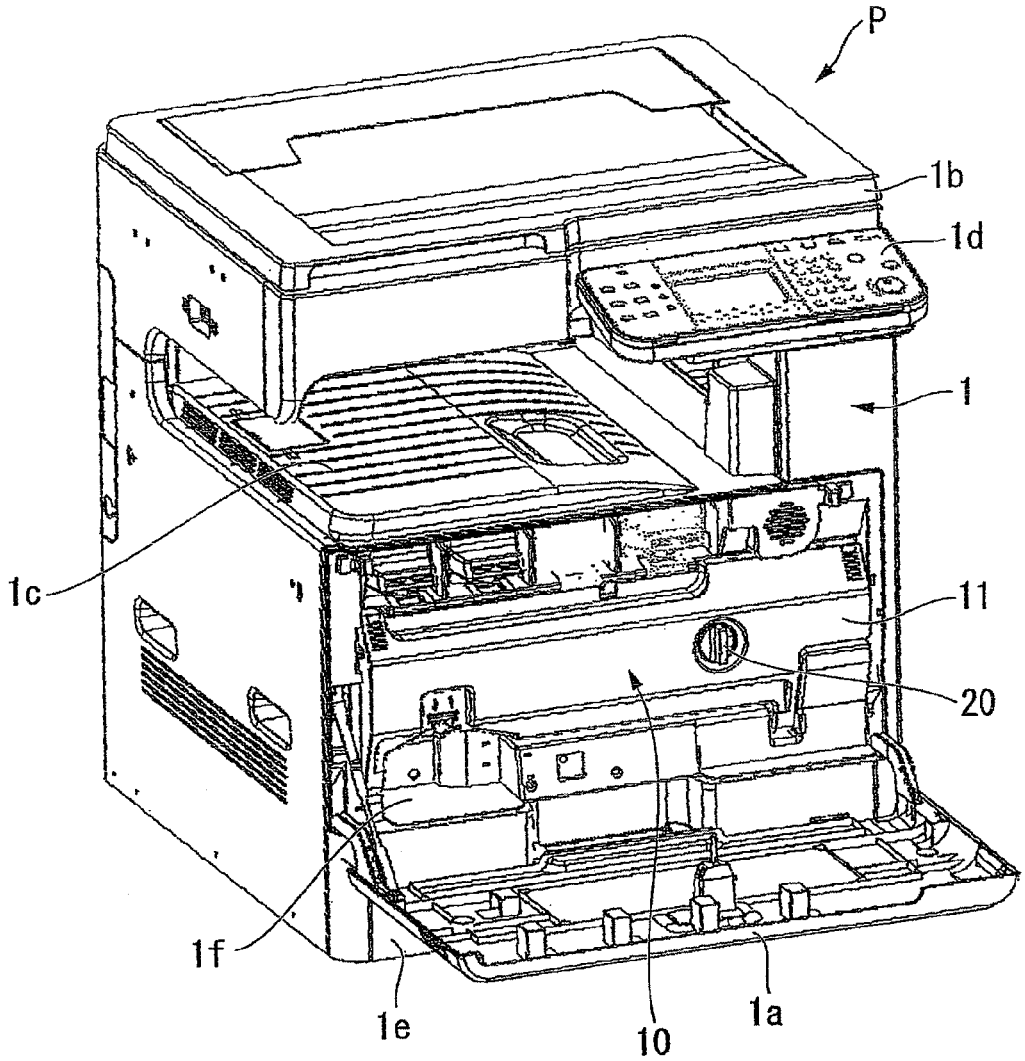
FIG. 3 is a perspective view of a copying machine applied with an image formation apparatus according to the above embodiment.
Figure 4:
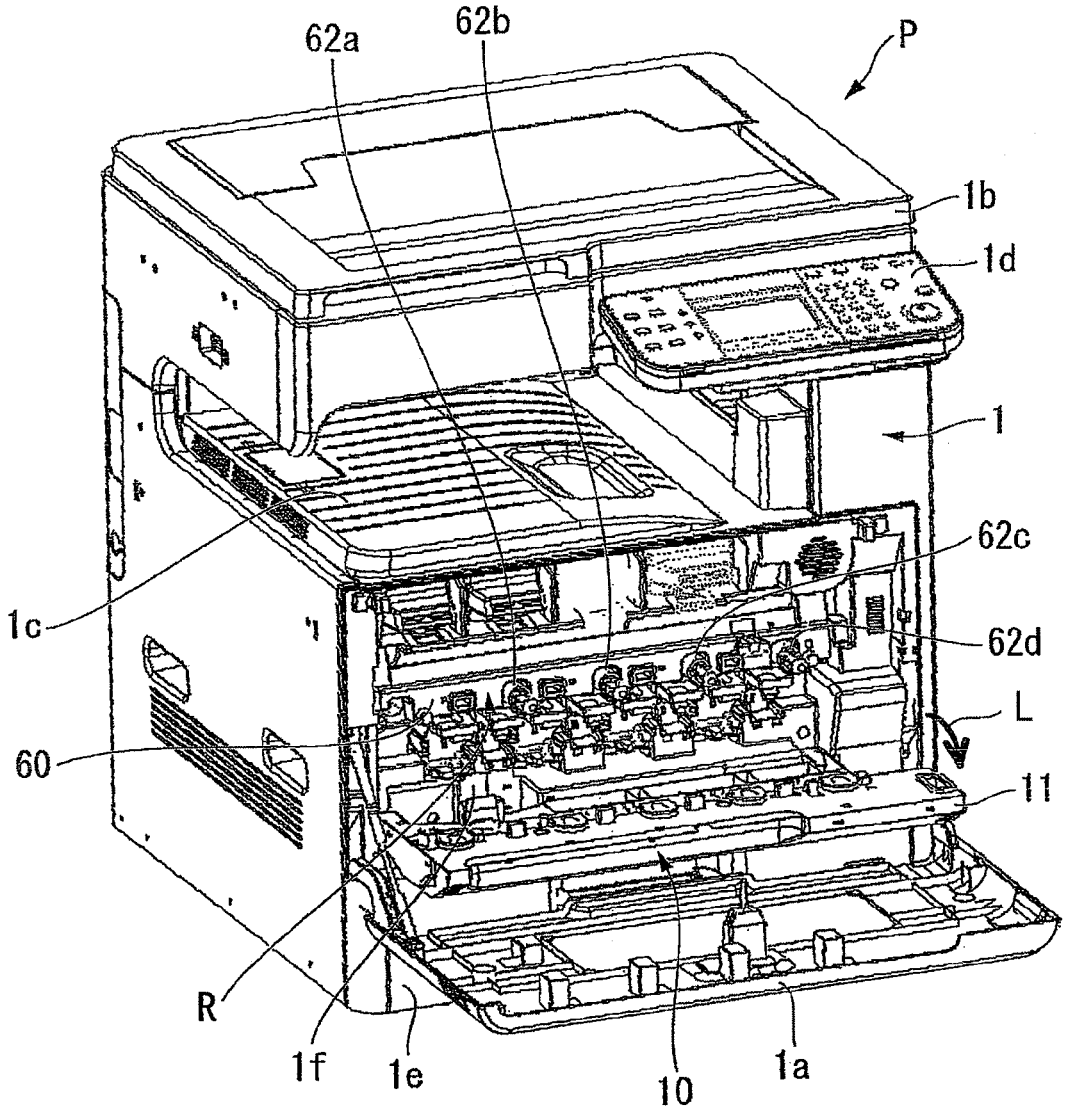
FIG. 4 is a perspective view of a copying machine applied with an image formation apparatus according to the above embodiment.
Figure 6:
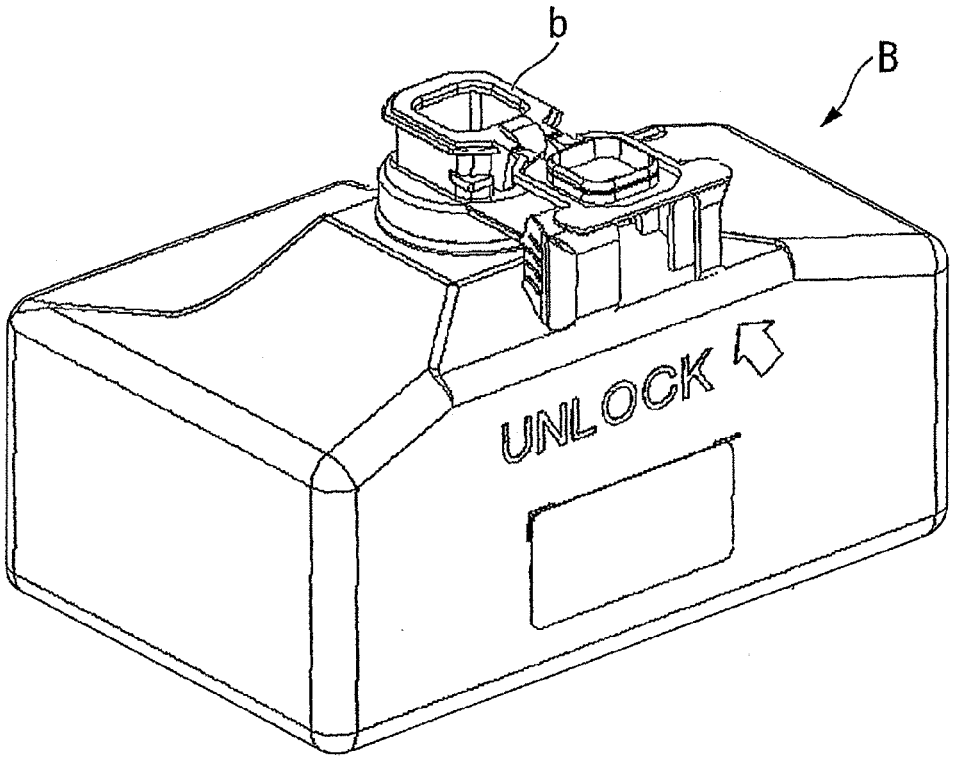
FIG. 6 is a perspective view of a waste toner bottle.

A waste toner bottle B is shaped as a rectangular parallelepiped. A predetermined capacity is provided inside the waste toner bottle B. A reception opening b is provided at a central part of an upper surface of the waste toner bottle B. The reception opening b is formed at a thickness portion of an upper surface side which is opened. This waste toner bottle B is provided to the waste toner bottle storing part 1*f* so that the waste toner bottle B may be freely attached to and detached from the waste toner bottle storing part 1*f*. The waste toner bottle storing part 1*f* is provided on the main body 1 at one side (in the example shown in the diagram, at the left side) of a lower part of the waste toner assembly 10. FIG. 2 shows a condition in which a waste toner bottle B is attached to a waste toner bottle storing part 1*f*. FIGS. 3, 4, and 5 show a condition in which the waste toner bottle B is detached from the waste toner bottle storing part 1*f*. FIG. 6 is a perspective view of a waste toner bottle.

The waste toner assembly 10 is configured to have a cover body 11 and a release lever 20.

The cover body 11 forms an outer frame of the waste toner assembly 10. Further, as shown in FIGS. 2 and 3, the cover body 11 is provided so as to cover a front surface of the main body 1 at an inner side of the front cover 1*a*. In addition, as shown in an arrow L in FIG. 4, the front cover 1*a* is configured so that an upper part side of the front cover 1*a* may rotate toward a frontal side with a lower part side being a central axis of rotation. In this way, the retainer R of the image formation part may be exposed. In this way, an image formation part including a retainer R is provided at a main body 1 at a deep inner side of the cover body 11.

Figure 7A:
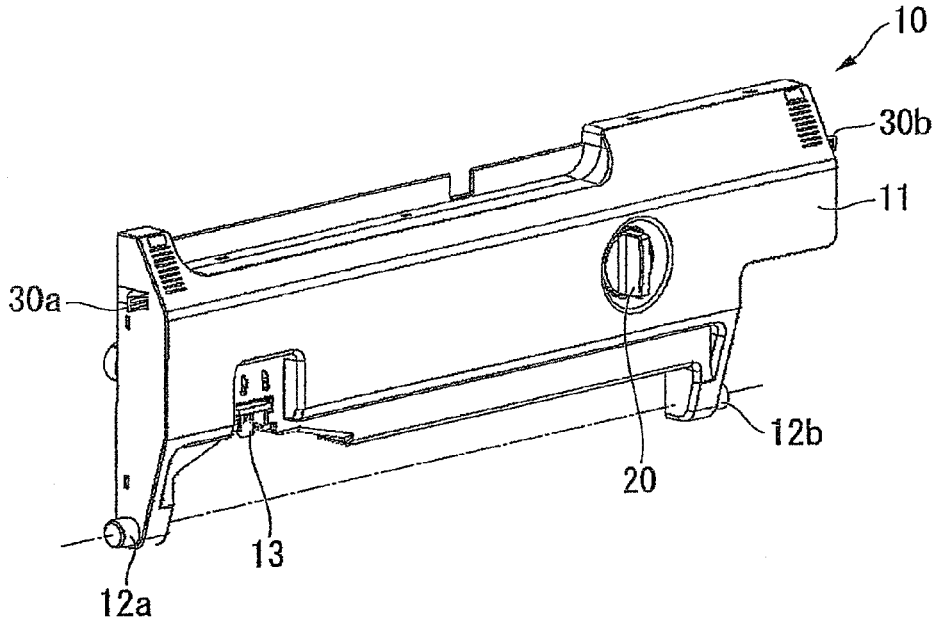
FIG. 7A is a perspective view of a waste toner assembly seen from a frontal side.
Figure 7B:
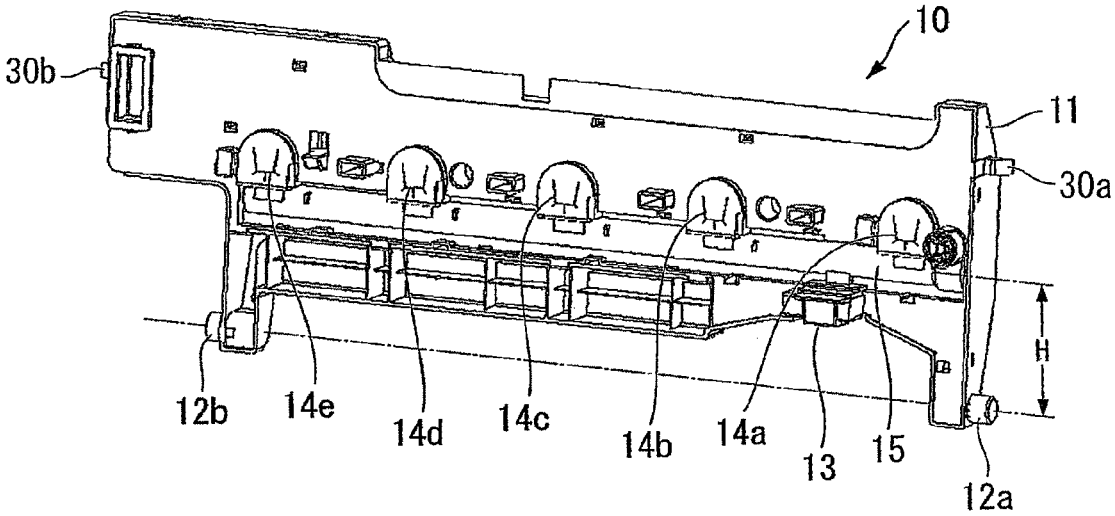
FIG. 7B is a perspective view of a waste toner assembly seen from a back side.

The cover body 11 is described in more detail with reference to FIGS. 7A and 7B. FIG. 7A is a perspective view of the waste toner assembly 10 seen from a front surface side. FIG. 7B is a perspective view of the waste toner assembly 10 seen from a back surface side. Supporting axes 12*a*, 12*b* are respectively provided at a left part and a right part of a lower side of the cover body 11. The supporting axis 12*a*, 12*b* rotatably supports the waste toner assembly 10. The supporting axes 12*a*, 12*b* are configured so that each of the supporting axis 12*a*, 12*b* may be inserted to an opening hole of the main body 1 which is not diagrammed.

A delivery opening storing part 13 is provided at a left part side of a lower side (see FIG. 7A) of the cover body 11. At the same time, at a horizontal part of a central part of the back surface, a plurality of receiving opening storing parts 14*a*-14*e* are provided (in the example shown in the diagram, five receiving opening storing parts are provided), with a predetermined interval being present between each receiving opening storing part.

The delivery opening storing part 13 is provided at a position corresponding to a reception opening b of the waste toner bottle B when the waste toner bottle B is attached to the main body 1. When the cover body 11 is closed as shown in FIG. 2 or FIG. 3, the receiving opening storing parts 14*a*-14*e* are provided at a position corresponding to a position of ejection openings 5*a*-5*d* of a waste toner being ejected from an image formation part side. In addition, at a lower part of the receiving opening storing parts 14*a*-14*e* at a back surface of the cover body 11, a storing part 15 is provided in a horizontal manner. The storing part 15 stores a transport pipe 42 (see FIG. 8A, FIG. 9B) described later.

The release lever 20 is provided at a right side of a front surface of the cover body 11. A rotational axis (not diagrammed) is provided on the release lever 20. The rotational axis is provided so as to penetrate a cover at a front surface side of the cover body 11. The rotational axis is provided to a frame described later so that the rotational axis may freely rotate.

Further, a pair of latching chips 30*a*, 30*b* (locking parts) are provided on the copying machine P according to the present embodiment. The latching chips 30*a*, 30*b* allows the waste toner assembly 10 to be freely attached and detached.

The pair of latching chips 30*a*, 30*b* are provided so that each of them may respectively protrude freely from both the left end side and the right end side of the upper side part of the cover body 11. Further, these latching chips 30*a*, 30*b* are configured so that each of them may be inserted to an opening hole of the main body 1 which is not diagrammed. Incidentally, these latching chips 30*a*, 30*b* are connected to the release lever 20 via a connecting rod described later.

Figure 8A:
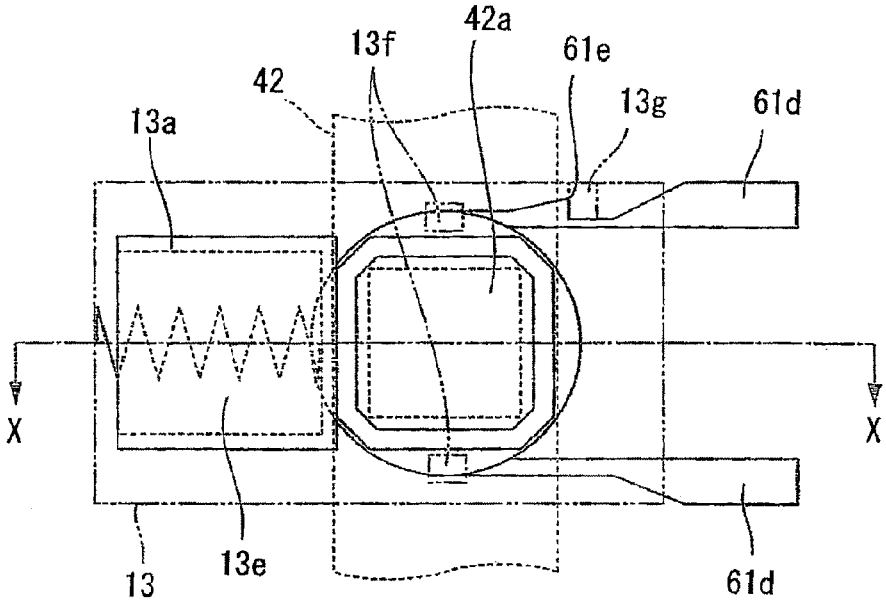
FIG. 8A is a schematic diagram showing a condition in which a reception opening of a waste toner bottle is attached to a delivery opening storing part.
Figure 8B:
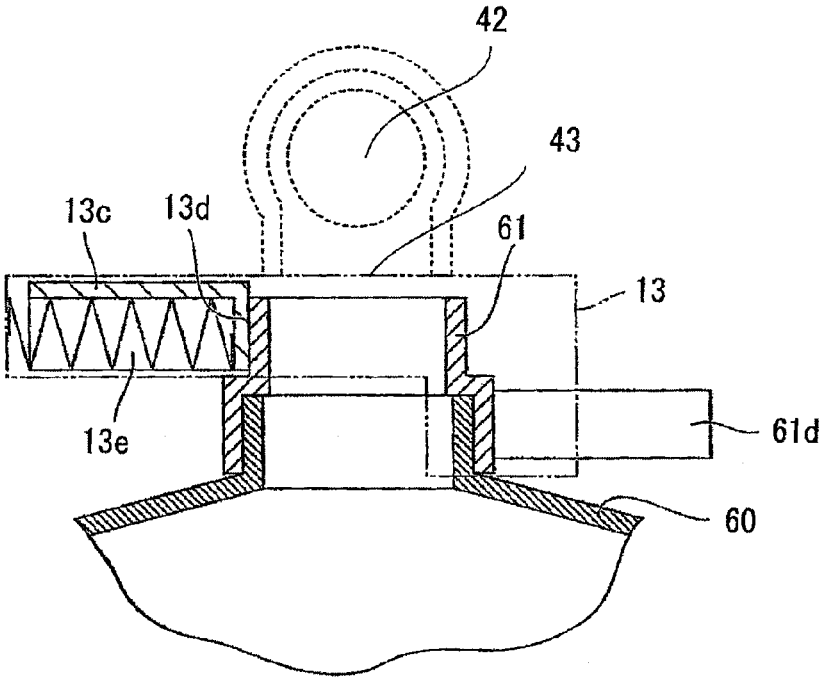
FIG. 8B is a schematic diagram showing a condition in which a reception opening of a waste toner bottle is attached to a delivery opening storing part.

FIGS. 8A and 8B are schematic diagrams showing a condition in which a reception opening b of a waste toner bottle B is attached to a delivery opening storing part 13. FIG. 8A is a planar view of the image formation apparatus seen from above. FIG. 8B is a cross sectional view of FIG. 7A along line X-X. A shutter part 13*a* is held by a delivery opening storing part 13 while being biased by a compression spring 13*b* in an opposite direction with respect to a direction in which the waste toner bottle B is equipped. The shutter part 13*a* covers a delivery opening 43 formed at a lower surface of a transport pipe 42. The shutter part 13*a* is formed by an opaque component. The shutter part 13*a* includes a lid part 13*c* covering the delivery opening 43, a contacting part 13*d* contacting the reception opening b of the waste toner bottle B, and a blocking part 13*e* blocking a full sensor 13*f*. The full sensor 13*f* is configured so that a light reception part detects light emitted by an illuminating part.

The waste toner bottle B comprises a tank part 80 and a cap part 81 fixed at a head part of the tank part 80. The cap part 81 acts as a reception opening b. The cap part 81 is formed by a material having elasticity and transparency. The cap part 61 comprises a neck part 81*a* and a shoulder part 81*b*. The neck part 81*a* opposes a lower portion of the delivery opening 43 of the transport pipe 42. The shoulder part 81*b* engages with a tank part 80 at a lower portion of the neck part 81*a*. Furthermore, at the shoulder part 81*b*, two knob parts 61*c*, 81*d* are provided so as to extend from a peripheral surface at opposing positions in the circumference direction. Meanwhile, a protrusion part 81*e* shaped like a wedge is formed on the knob part 81*d*.

When the waste toner bottle B is not attached to the delivery opening storing part 13, the shutter 13*a* moves toward the right direction in FIGS. 8A, 8B due to the compression spring 13*b*. Thus, the shutter 13*a* covers the delivery opening 43 of the transport pipe 42. When the waste toner bottle B is attached to the waste toner bottle storing part 1*f*, the shutter part 13*a* contacts the neck part 81*a*, moves toward the left direction in opposition to the bias by the compression spring 13*b*, and retreats from the delivery opening 43. Instead, the neck part 61*a* is placed opposite the delivery opening 43. At this position, the protrusion part 81*e* of the knob part 61*d* engages with the latching part 13*b* formed on the delivery opening storing part 13. Thus, a movement toward the right direction is restricted.

When the waste toner bottle B attached to the delivery opening storing part 13 is pulled out, pinching the knob parts 81*c*, 81*d* with one's fingers leads to the knob parts 81*c*, 81*d* undergoing an elastic deformation. As a result, the protrusion part 61*e* retreats from the latching part 13*g*, thereby releasing the latching. Further, the waste toner bottle B is pushed out into the push-out direction by a biasing force of the compression spring 13*b*.

FIGS. 9A, 9B, 10A, and 10B show an inner configuration of the waste toner assembly 10 in a condition in which the cover body 11 is removed from the waste toner assembly 10. In other words, a frame 40 is provided at an inner part of the waste toner assembly 10. Further, the release lever 20, described above, is provided to the frame 40. In addition, reception openings 41*a*-41*e*, a transport pipe 42, and a reception opening 43 are provided on the frame 40.

As described above, the release lever 20 is provided on the frame 40 so that the release lever 20 may rotate freely. Further, a connecting rod 50 is connected to an upper part of a shaft center passing through a central point of the release lever 20 so that the connecting rod 50 may slide freely. A tip of the connecting rod 50 is formed on the latching chip 30*a*. The connecting rod 50 is biased by a spring 50*a*. At a lower part of the shaft center passing through a central point of the release lever 20, a connecting rod 51 is provided so that the connecting rod 51 may slide freely. A tip of the connecting rod 51 is formed on the latching chip 30*b*. The connecting rod 51 is biased by a spring 51*a*. At a further lower portion, a connecting rod 53 is connected so that the connecting rod 53 may slide freely. The connecting rod 53 is formed integrally with the connecting rod 51. At the same time, the connecting rod 53 is positioned below the connecting rod 50. The connecting rod 53 extends in a direction opposite to the connecting rod 51. A tip of the connecting rod 53 is formed on the locking part 52.

Figure 14A:
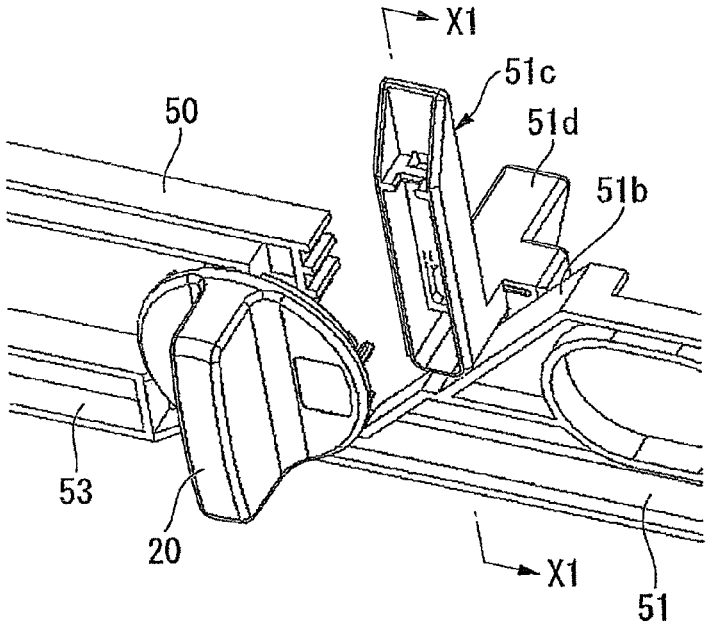
FIG. 14A is an enlarged perspective view of a release lever part when a release lever is fixed.
Figure 14B:
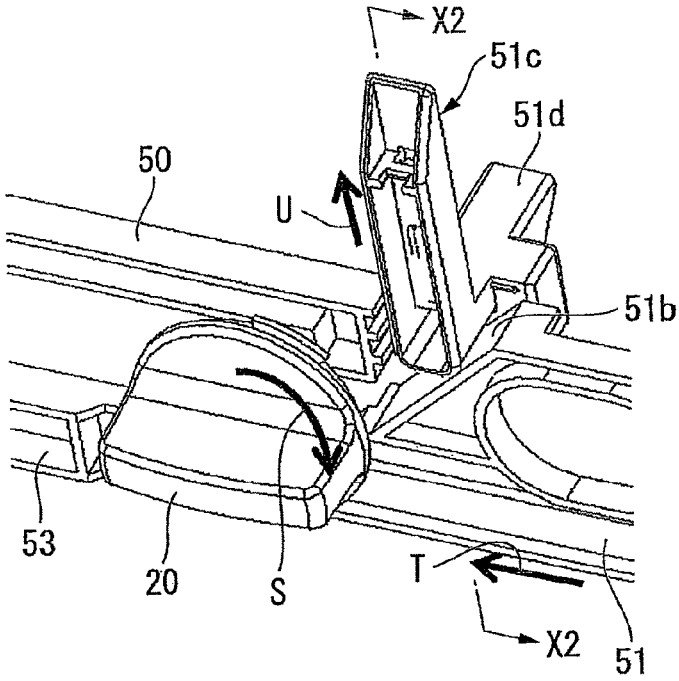
FIG. 14B is an enlarged perspective view of a release lever part when a release lever is released.

A sloped surface 51*b* is provided at an upper surface of the connecting rod 51 at a release lever 20 side. The height of a point on the sloped surface 51*b* becomes higher as the point moves away from the release lever 20. Further, a retainer lever release part 51*c* is mounted on the sloped surface 51*b* so that the retainer lever release part 51*c* may slide freely. The retainer lever release part 51*c* is restricted from moving in a longitudinal direction of the connecting rod 51, i.e., the lateral direction. At the same time, the retainer lever release part 51*c* may move freely in a direction perpendicular to the longitudinal direction of the connecting rod 51, i.e., the longitudinal direction. As shown in FIGS. 14A, 14B described later, a contacting surface 51*d* is integrally provided to a lower portion of the retainer lever release part 51*c*. The contacting surface 51*d* protrudes toward a deep inner side of the main body 1. The contacting surface 51*d* is configured so that the retainer lever, described later, may be contacted.

Figure 9A:
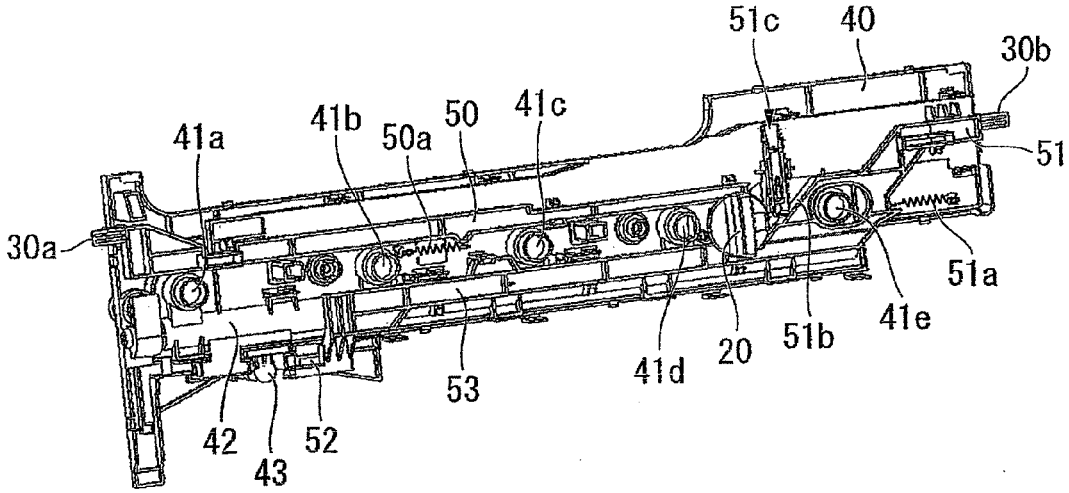
FIG. 9A is a perspective view of a condition in which a cover body is detached from a waste toner assembly, and a release lever is fixed.
Figure 10A:
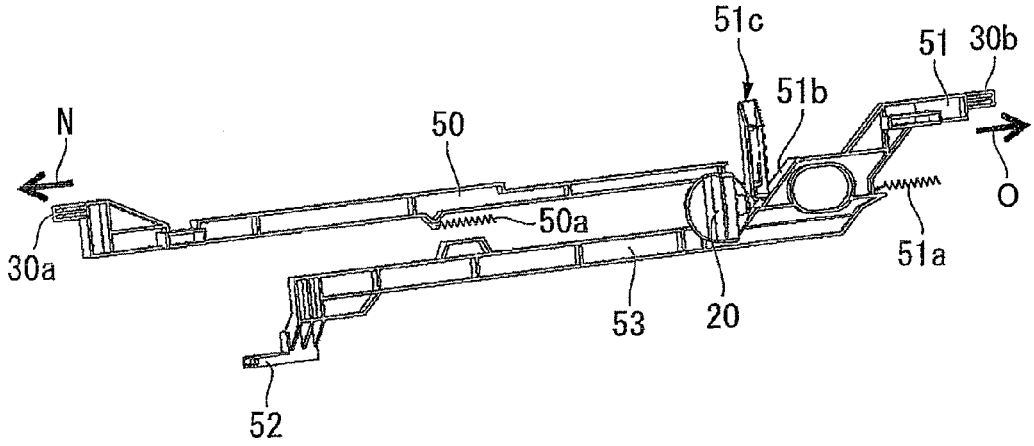
FIG. 10A is a perspective view of a connecting rod when a release lever is fixed.

FIG. 9A and FIG. 10A respectively show a position of each of the connecting rods 50, 51, and 53 when the release lever 20 is fixed in a counter clockwise direction, i.e., when the release lever 20 is prevented from rotating in the counter clockwise direction. At this time, the latching chip 30*a* is biased toward the outer side by a spring 50*a*, 51*a* so as to move away from the position of the release lever 20, as shown by an arrow M in FIG. 10A. Further, as shown by an arrow O in FIG. 10A, the latching chip 30*b* is also biased toward the outer side by the spring 50*a*, 51*a*.

Figure 9B:
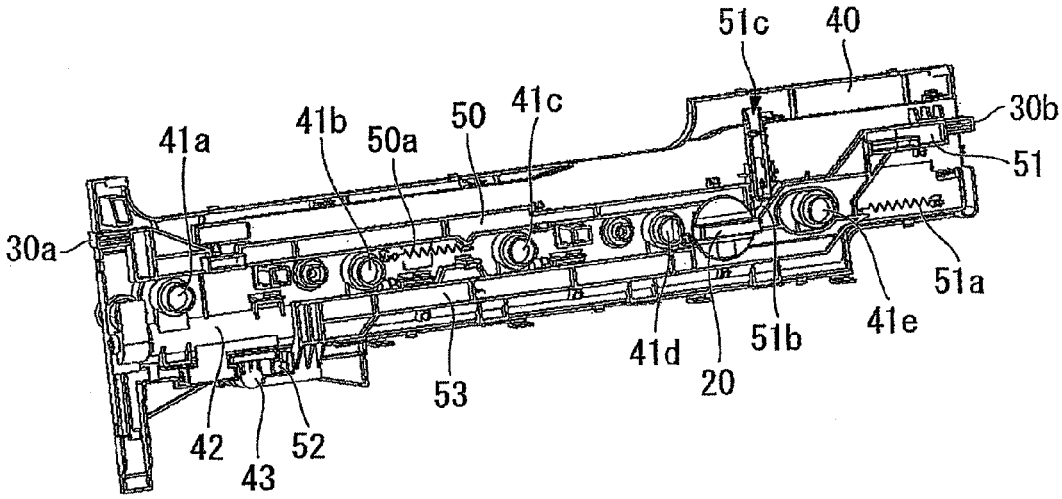
FIG. 9B is a perspective view of a condition in which a release lever is released.
Figure 10B:
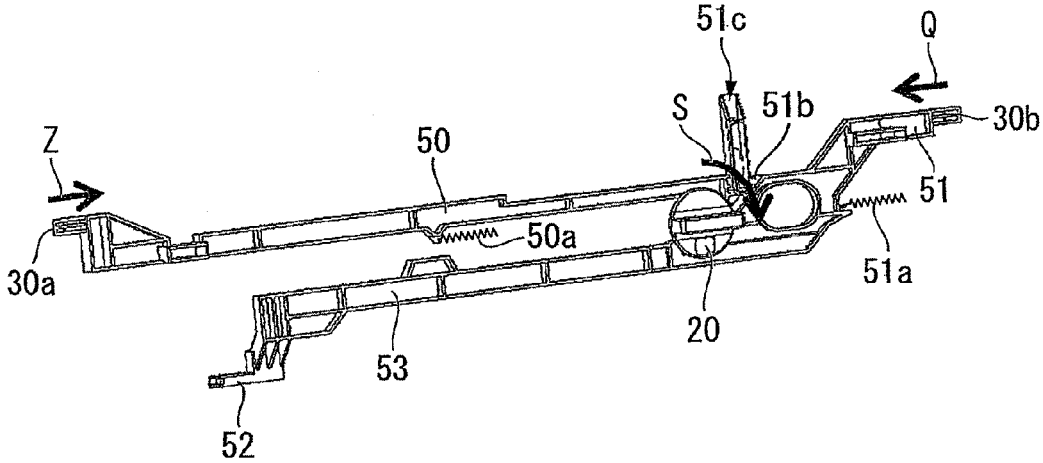
FIG. 10B is a perspective view of a connecting rod when a release lever is released.

FIGS. 9B and 10B show a position of each of the connecting rods 50, 51, 53 when the release lever 20 is rotated 90 degrees in a clockwise direction in resistance to the spring 50*a* and the spring 51*a*. At this time, the latching chip 30*a* moves toward a center at which the release lever 20 is positioned, as shown in an arrow Z in FIG. 10B. Further, as shown by an arrow Q in FIG. 10B, the latching chip 30*b* also moves toward the center.

Figure 11:
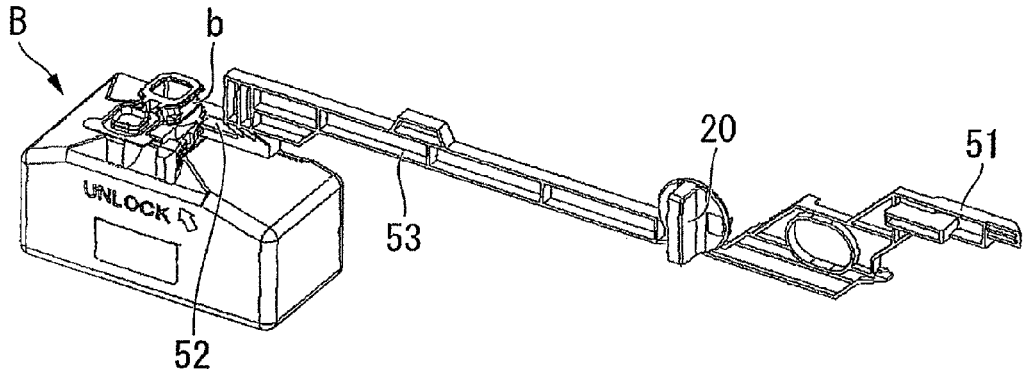
FIG. 11 is a perspective view of a condition in which a locking part is in contact with a waste toner bottle.
Figure 12:
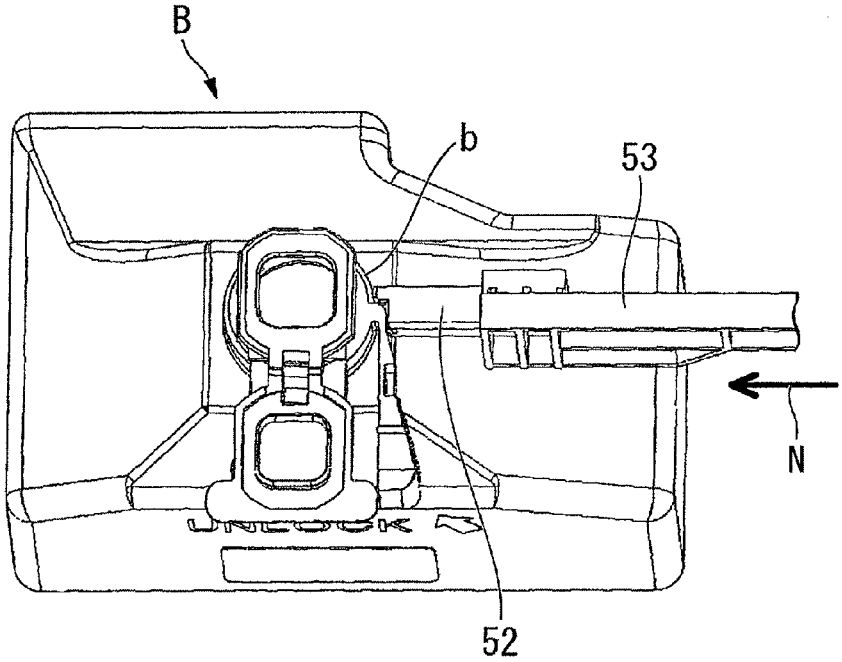
FIG. 12 is an enlarged perspective view of a condition in which a locking part is in contact with a waste toner bottle.

FIG. 11 is a perspective view of a condition in which a locking part 52 is in contact with the waste toner bottle B. FIG. 12 is an enlarged perspective view of a condition in which the locking part 52 is in contact with the waste toner bottle B. Next, a relationship between the waste toner bottle B and the connecting rod 53 is described. The locking part 52 is provided at the tip of the connecting rod 53. As shown in FIGS. 2, 11, and 12, when the waste toner bottle B is attached to the waste toner bottle storing part if of the main body 1, the reception opening b is positioned at the reception opening 43 (the delivery opening storing part 13 provided at the cover body 11). The reception opening b is formed on a thickness part of the waste toner bottle. Further, the relationship between the reception opening b and the locking part 52 of the connecting rod 53 at this time is determined so that the locking part 52 of the connecting rod 53 can contact a side surface of the reception opening b. Therefore, when the waste toner bottle B is attached to the waste toner bottle storing part 1*f*, the locking part 52 of the connecting rod 53 is in contact with the side surface of the reception opening b of the waste toner bottle B. As a result, the connecting rod 53 is prevented from moving toward an outer direction (i.e., the left side direction in FIGS. 8A and 8B). Further, the release lever 20 is prevented from rotating. Thus, a locked condition is maintained.

The reception openings 41*a*-41*e* are provided at a location corresponding to the location of delivery opening storing parts 14*a*-14*e* provided on the cover body 11. Further, the transport pipe 42 is provided at a position corresponding to the position of the transport pipe storing part 15 provided on the cover body 11.

The transport pipe 42 is made of a screw conveyer. In other words, inside the transport pipe 42, although not diagramed, a spiral is provided. This spiral is rotated and driven in the direction of the shaft center of the pipe by a motor. Further, this transport pipe 42 made of a screw conveyer is configured so that a waste toner, entered from the reception openings 41*a*-41*e*, may be transported to a reception opening 43 side.

When the frame 40 is attached to the cover body 11, the transport pipe 42 provided on the frame 40 is positioned upwards by a predetermined distance (see "H" in FIG. 7B) from a position of the supporting axis 12*a*, 12*b* of the rotational axis of the cover body 11. Therefore, when the cover body 11 is opened and closed, the posture of the transport pipe 42 may be altered according to its movement.

The reception opening 43 is provided at a position corresponding to the position of the delivery opening storing part 13 provided on the cover body 11. From this reception opening 43, a waste toner transported from the transport pipe 42 is ejected so that the waste toner falls. A configuration is made so that the waste toner may be entered into the reception opening b of the waste toner bottle B positioned below the reception opening 43.

Figure 13A:
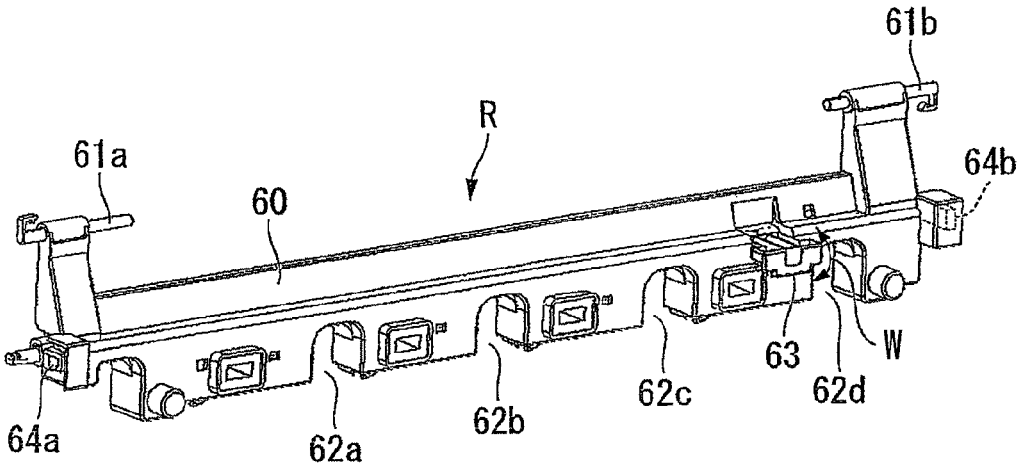
FIG. 13A is a perspective view of a retainer seen from a frontal side.
Figure 13B:
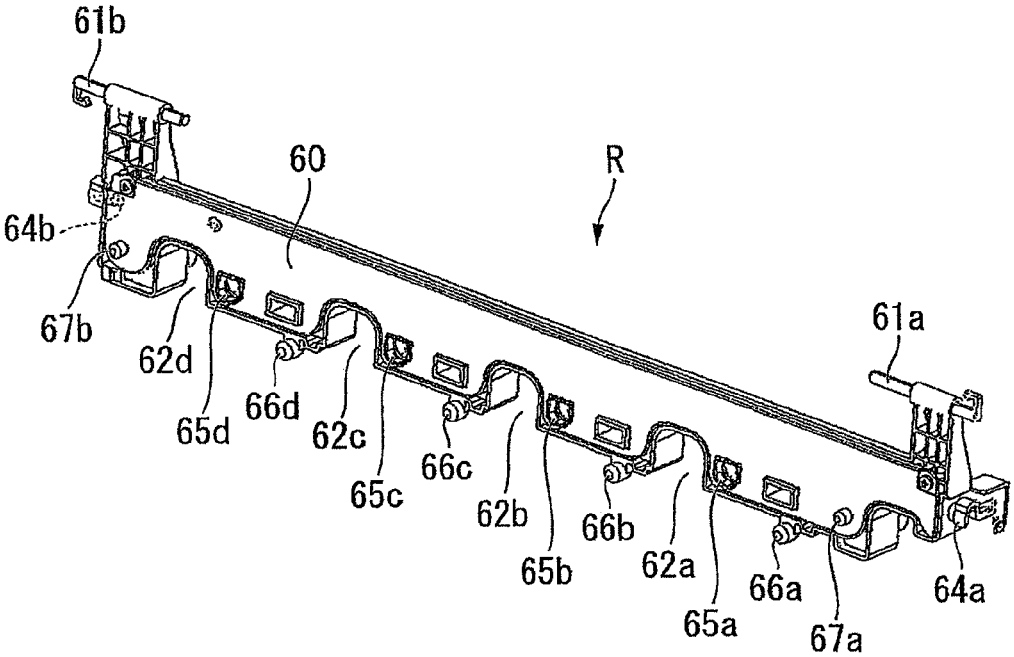
FIG. 13B is a perspective view of a retainer seen from a back side.
Figure 15A:
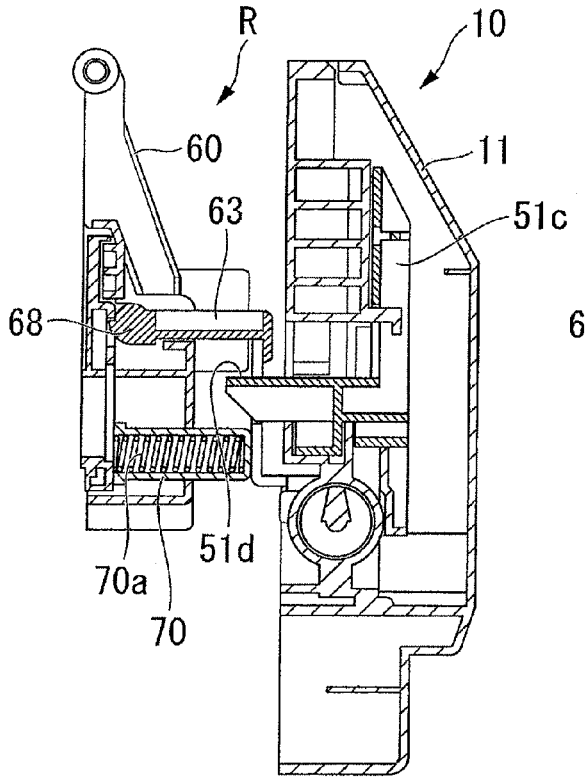
FIG. 15A is a cross sectional view of FIG. 10A along line X1-X1.
Figure 15B:
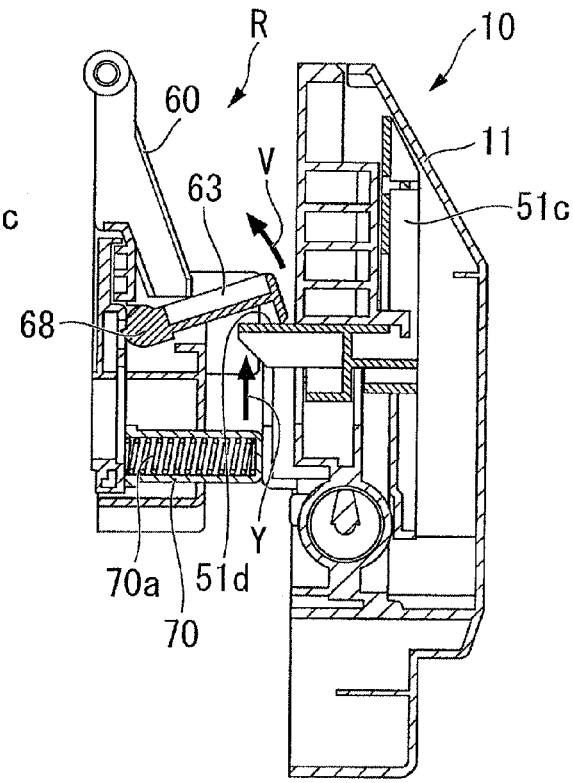
FIG. 15B is a cross sectional view of FIG. 10B along line X2-X2.

Next, the retainer R is described with reference to FIGS. 13A, 13B, 14A, 14B, 15A, and 15B. FIG. 13A is a perspective view of the retainer R seen from a frontal side. FIG. 13B is a perspective view of the retainer R seen from a back side. FIG. 14A is an enlarged perspective view of a release lever part when a release lever is fixed. FIG. 14B is an enlarged perspective view of a release lever part when a release lever is released. FIG. 15A is a cross sectional view of FIG. 14A along line X1-X1. FIG. 15B is a cross sectional view of FIG. 14B along line X2-X2.

This retainer R is configured to appear when the cover body 11 is opened (see FIG. 4). In other words, this retainer R is provided inside the main body 1 so that the retainer R faces a back side of the cover body 11 when the waste toner assembly 10 is closed. The retainer R includes a retainer main body 60, holding parts 62*a*-62*d*, and a retainer lever 63.

The retainer main body 60 is formed to be approximately the same size as an upper half portion of the cover body 11 of the waste toner assembly 10. At the left and right sides of the upper part of the retainer main body 60, an axis part 61*a*, 61*b* is respectively provided. The retainer main body 60 is provided on the main body 1 so that the retainer main body 60 may rotate freely via the axis part 61*a*, 61*b*. Latching holes 64-64*d*, latching protrusions 65*a*-65*d*, and position determining protrusion 66*a*, 66*b* are formed on the retainer main body 60. The latching holes 64*a*-64*d* latch with the axis parts 4*a*-4*d* of the photoreceptor units 2*a*-2*d*. The latching protrusions 65*a*-65*d* latch with the position determining holes 6*a*-6*d* of the developing units 3*a*-3*d*. The position determining protrusions 66*a*, 66*b* latch with the position determining parts 1*g*, 1*h* (see FIG. 5) formed on the main body 1.

The holding parts 62*a*-62*d* are provided at a lower part side of the retainer main body 60. A predetermined interval is provided between each holding parts 62*a*-62*d*. These intervals are determined by the position of the axis part of the plurality of photoreceptors (in the example shown in the diagram, four photoreceptors) assembled into the image formation part. In other words, as the retainer main body 60 is shown in FIG. 4, the holding parts 62*a*-62*d* are configured so that the ejection openings 5*a*-5*d* of the waste toner ejected from the image formation part side in a closed condition protrud toward the waste toner assembly 10. At this time, the photoreceptor units 2*a*-2*d* are positioned with respect to the main body 1, and the developing units 3*a*-3*d* are positioned with respect to the main body 1 as the axis parts 4*a*-4*d* of the photoreceptor units 2*a*-2*d* latch with the latching holes 65*a*-65*d*, the positioning holes 6*a*-6*d* of the developing units 3*a*-3*d* latch with the latching protrusions 66*a*-66*d*, and as the position determining parts 1*g*-1*f* of the main body latch with the position determining protrusions 67*a*-67*b*. Further, when the retainer main body 60 is opened as shown in arrow M in FIG. 5, a holding condition of the photoreceptor units 2*a*-2*d* and the developing units 3*a*-3*d* are released. Thus, a configuration is made so that the photoreceptor units 2*a*-2*d* and the developing units 3*a*-3*d* may be pulled out.

The retainer lever 63 is provided so that a portion of the retainer lever 63 protrudes from a frontal surface of the retainer main body 60 (see FIG. 13A). A configuration is made so that the protruding portion may move in the upper and lower direction (see arrow W in FIG. 13A). The retainer lever 63 is provided near a position opposing the release lever 20. The release lever 20 is provided on the cover body 11 of the waste toner assembly 10. In other words, the retainer lever 63 is provided so that, in a condition in which the retainer main body 60 is closed as shown in FIG. 4, the retainer lever 63 may contact the contacting surface 51*d* of the retainer lever release part 51*c* provided on the connecting rod 51.

Further, latching chip 64*a*, 64*b* (locking part) are provided on the copying machine P according to the present embodiment so that the retainer R may be attached and detached.

The latching chip 64*a*, 64*b* are provided respectively at a position in the left and right side of the lower part of the retainer main body 60 and below the axis parts 61*a*, 61*b*. The latching chip 64*a*, 64*b* are connected via the retainer lever 63 and a linking mechanism which is not diagrammed. Further, when the retainer main body 60 is closed, the latching chip 64*a*, 64*b* fix the retainer main body 60 to the main body 1 side. When the retainer lever 63 moves upwards, the locked condition of the latching chip 64*a*, 64*b* are released. A configuration is made so that the retainer main body 60 may be rotated via the axis parts 61*a*, 61*b*.

The above movement of the latching chip 64*a*, 64*b* are described in further detail with reference to FIG. 14B and FIG. 15B. When the release lever 20 is rotated in a direction of the arrow S in FIG. 14B, the connecting rod 53 moves toward the direction of the arrow T. Accordingly, the sloped surface 51*b* also moves in the same direction of the arrow T. As a result, the release part 51*c*, mounted on the sloped surface 51*b*, moves upward as shown by the arrow U. Further, when the released part 51*c* moves upwards, the contacting surface 51*d*, which is configured to be integrated with the release part 51*c*, moves upward as well (see arrow Y in FIG. 15B). Further, the retainer lever 63, which is mounted on the contacting surface 51*d*, moves upward (see arrow V in FIG. 15B). In other words, the latching chips 64*a*, 64*b* may simultaneously release the locked condition of the retainer R by operating the release lever 20 which releases the locked condition of the waste toner assembly 10.

Figure 16A:
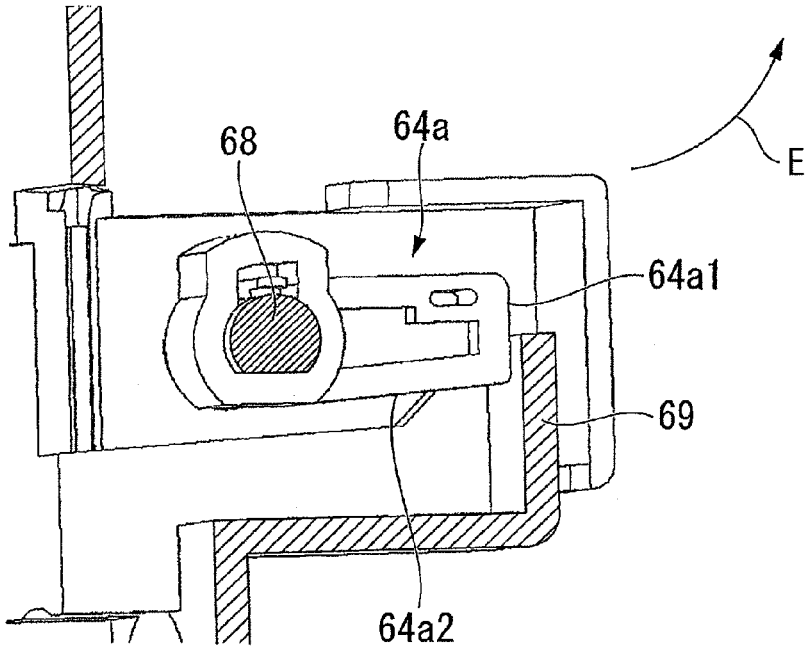
FIG. 16A is an enlarged perspective view of a latching chip when a retainer is locked.
Figure 16B:
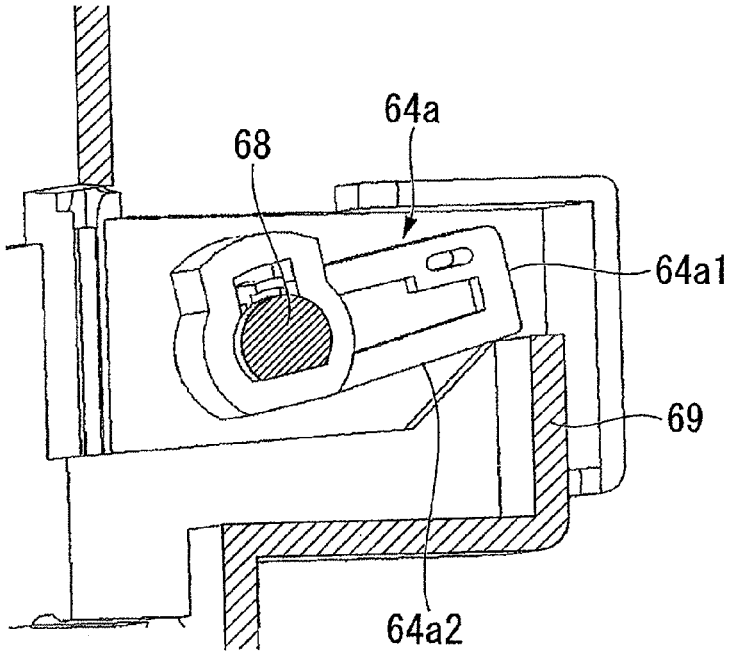
FIG. 16B is an enlarged perspective view when a lock of a retainer is unlocked.

Next, the latching chip 64*a* is described in further detail with reference to FIGS. 16A and 16B. FIGS. 12A, 12B are enlarged perspective views of a configuration including the latching chip 64*a*. As shown in FIGS. 16A, 16B, the latching chip 64*a* rotates around the shaft 68 according to the rotation of the shaft 68. At a frontal side of the latching chip 64*a*, the wall part 69 provided on the main body 1 is provided so that a wall surface of the wall part 69 faces the latching chip 64*a*. When the retainer R is locked, the latching chip 64*a* is assembled with respect to the shaft 68 so that the tip 64*a*1 faces the wall part 69, as shown in FIG. 16A. Therefore, when the retainer R is locked and a retainer main body 60 is rotated in the direction of the arrow E, the latching chip 64*a* is latched by the wall part 69, thereby restraining the retainer main body 60.

Meanwhile, when the lock of the retainer R is released, i.e., when the retainer lever 63 is moved upwards, the latching chip 64*a* is rotated along with the rotation of the shaft 68 so that the tip 64*a*1 is elevated. The tip 64*a*1 of the latching chip 64*a* is elevated above the wall part 69 (see FIG. 16B). As a result, the retainer main body 60 may be rotated in the direction of the arrow E.

Further, when the retainer main body 60 is returned to its original position, the retainer main body 60 is rotated in a direction opposite to the arrow E. At this time, the lower surface 64*a*2 of the latching chip 64*a* hits the upper end of the wall part 69. Thus, the tip 64*a*1 of the latching chip 64*a* is elevated. The tip 64*a*1 of the latching chip 64*a* is elevated until it is brought to a position above the wall part 69 according to the movement of the retainer main body 60. Further, when the tip 64*a*1 reaches a position above the wall part 69, the latching chip 64*a* rotates with its own weight to lower the tip 64*a*1. Thus, the retainer R is locked once again.

Incidentally, a configuration of the latching chip 64*a* side was described here. The latching chip 64*b* side is configured in a same manner because the latching chip 64*a* and the latching chip 64*b* are bilaterally symmetric.

Further, as shown in FIGS. 15A and 15B, a pushing part 70 is provided on the retainer main body 60. The pushing part 70 pushes the cover body 11 of the waste toner assembly 10 from a back side. A coil spring 70*a* is stored inside the pushing part 70. The pushing part pushes the waste toner assembly 10 from a back side while the waste toner assembly 10 is rotated in order to restore it from an opened condition to its original state. This pushing part 70 allows the retainer main body 60 to be returned reliably to a locked condition for the following reasons.

Figure 17:
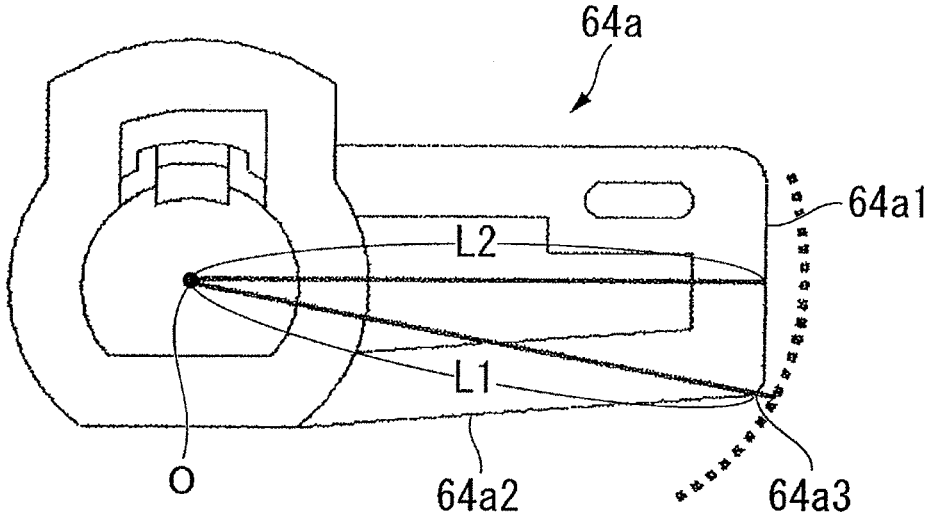
FIG. 17 is a frontal view of a latching chip according to FIG. 12.

As shown in FIGS. 16A and 16B, the latching chip 64*a* (and the latching chip 64*b* in the same manner) rotates around the shaft 68 so as to elevate and lower the tip 64*a*1. Therefore, as described above, in order to place the latching chip 64*a* above the wall part 69 to return the retainer main body 60 to a locked condition, the maximum external part 64*a*3 (a part having the largest distance from the center of rotation O) of the latching chip 64*a* shown in FIG. 17 needs to come above the wall part 69. This distance L1 from the center of rotation O to the maximum external part 64*a*3 is longer than the distance L2 from the center of rotation O to the tip 64*a*1. Therefore, in order to return the retainer main body 60 to a locked condition, the retainer main body 60 needs to be pushed in once toward a rear side compared to a posture in the locked condition.

Figure 18:
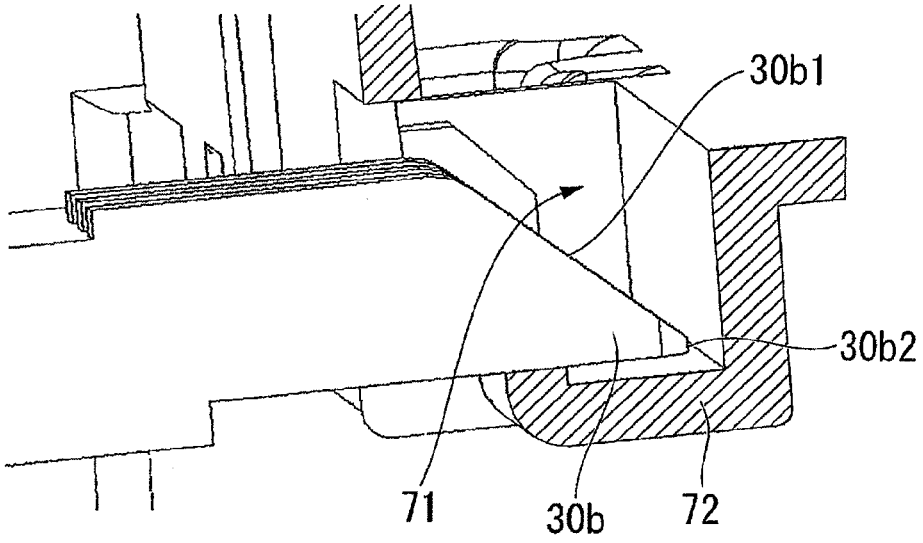
FIG. 18 is an enlarged perspective view of a configuration including a latching chip when a waste toner assembly is locked.

Meanwhile, as shown in FIG. 18, the waste toner assembly 10 becomes locked when the latching chip 30*b* enters the opening 71 of the main body 1. This configuration applies to the latching chip 30*a* as well. The latching chip 30*b* comprises a sloped surface 30*b*1 facing the retainer R side. When the waste toner assembly 10 is returned to the locked condition, the latching chip 30*b* is gradually pushed in while the sloped surface 30*b*1 contacts the wall part 72 at the front of the opening 71. Thus, the tip 30*b*2 of the latching chip 30*b* comes above the wall part 72. As a result, the latching chip 30*b* enters the opening 71 of the main body 1 due to the biasing force of the spring 51*a*. Therefore, the waste toner assembly 10 may be returned to the locked condition by assuming the posture of the locked condition.

Here, when each of the retainer main body 60 and the waste toner assembly 10 are returned to the locked condition independently of one another, the vibration that occurs when the latching chip 64*a* comes above the wall part 69 is conveyed to the user. This configuration applies to the latching chip 64*b* as well. In this way, the user is able to know that the retainer main body 60 is in a locked condition. Therefore, the retainer main body 60 may be returned to a locked condition in a reliable manner without any specific problems. However, when the user tries to put both the waste toner assembly 10 and the retainer main body 60 in a locked condition at once, i.e., when the user pushes in the waste toner assembly 10 only while pushing in the retainer main body 60 via the waste toner assembly 10, the latching chip 30*b* enters the opening 71 when the waste toner assembly 10 reaches a posture of the locked condition. This configuration applies to the latching chip 30*a* as well. In this way, the waste toner assembly 10 becomes locked before the retainer main body 60. Therefore, due to the vibration that occurs when the latching chip 30*b* enters the opening 71, the user might mistakenly believe that the retainer main body 60 is locked as well. As a result, the retainer main body 60 is not in a locked condition, and an image formation cannot be commenced.

On the other hand, according to the present embodiment, a pushing part 70 is provided. As a result, the waste toner assembly 10 is pushed back with a greater force. Hence, the user will be pushing in the waste toner assembly 10 with a significant amount of force. As a result, the retainer main body 60 is adequately pushed into a rear side. Thus, the retainer main body 60 may be returned to the locked condition in a reliable manner.

A transporting movement of the waste toner of the copying machine P configured as described above is described below. In addition, the releasing operation of the retainer R is also described.

The copying machine P is configured so that a waste toner is generated from the image formation part when a copying is performed. The waste toner that was generated is entered inside the transport pipe 42 via the reception openings 41*a*-41*e* ejected from the ejection openings 5*a*-5*d*. The waste toner, which was entered inside the transport pipe 42, is transported to the reception opening 43 via the rotation of the spiral. Thus, the waste toner is collected inside the waste toner bottle B from the reception opening b. When a full sensor 13*f* detects that the waste toner bottle B became full with the waste toner, the full waste toner bottle B is exchanged with an empty waste toner bottle B.

The waste toner bottle B is exchanged so that the front cover 1*a* is opened (see arrow K in FIG. 2), the waste toner bottle B is pulled out from the waste toner bottle storing part 1*f* of the main body 1 as shown in FIG. 3, and a new empty waste toner bottle B is provided instead.

When the retainer R is released during maintenance and inspection of the image formation part, the front cover 1*a* is opened, the waste toner bottle B is pulled out from the waste toner bottle storing part 1*f*, and a release lever 20 is rotated. In other words, since the waste toner bottle B is pulled out from the waste toner bottle storing part 1*f*, the locking part 52 of the connecting rod 53 becomes free, thereby releasing the locked condition of the release lever 20. As a result, as shown in FIGS. 9B, 10B, and 14B, the release lever 20 may be rotated 90 degrees in a counter clockwise direction.

When the release lever 20 is rotated as described above, the latching chip 30*a* and the latching chip 30*b* are detached from latching parts on the main body 1. These latching parts are not diagrammed. Thus, the waste toner assembly 10 may be opened (detached) (see arrow L in FIG. 4). In this way, the waste toner assembly 10 may be opened only when the waste toner bottle B is pulled out from the waste toner bottle storing part 1*f*. Hence, the waste toner assembly 10 is prevented from being twisted by contacting the waste toner bottle B, such as when the waste toner assembly 10 rotated inappropriately in a condition in which the waste toner bottle B was attached.

At the same time when the release lever 20 is rotated, the locked condition of the retainer R is also released simultaneously. In other words, when the release lever 20 is rotated, the release part 51*c* moves upward. In addition, the contacting surface 51*d*, formed integrally with the release part 51*c*, moves upward. Therefore, the retainer lever 63, which is mounted on the contacting surface 51*d* of the release part 51*c*, moves upward. Thus, the latching chip 64*a*, 64*b* is released. Accordingly, the locked condition of the retainer R is released. In this way, according to the copying machine P, when the release lever 20 provided on the waste toner assembly 10 is rotated, the locking condition of the waste toner assembly 10 is released along with the locked condition of the retainer R. As a result, a higher operability during maintenance and inspection may be achieved.

Further, according to the copying machine P, since the waste toner assembly 10 rotates, an impact is more or less provided to the waste toner assembly 10 itself. At the same time, the posture of the transport pipe 42 changes. The transport pipe 42 is provided above the supporting axes 12*a*, 12*b* of the cover body 11 by a predetermined distance (see "H" of FIG. 7B). Therefore, when the assembly 10 rotates, the posture of the transport pipe 42 changes. Therefore, the waste toner which was attached to the inner wall surface of the transport pipe 42 and the like is detached and collapsed. In this way, a clogged condition of the transport pipe may be dissolved effectively. As a result, the transport capacity of the transport pipe 42 may be maintained well.

Next, a second embodiment is described. In the following description, configurations that are similar to the first embodiment described above are explained in a simplified manner or not explained at all.

Figure 19:
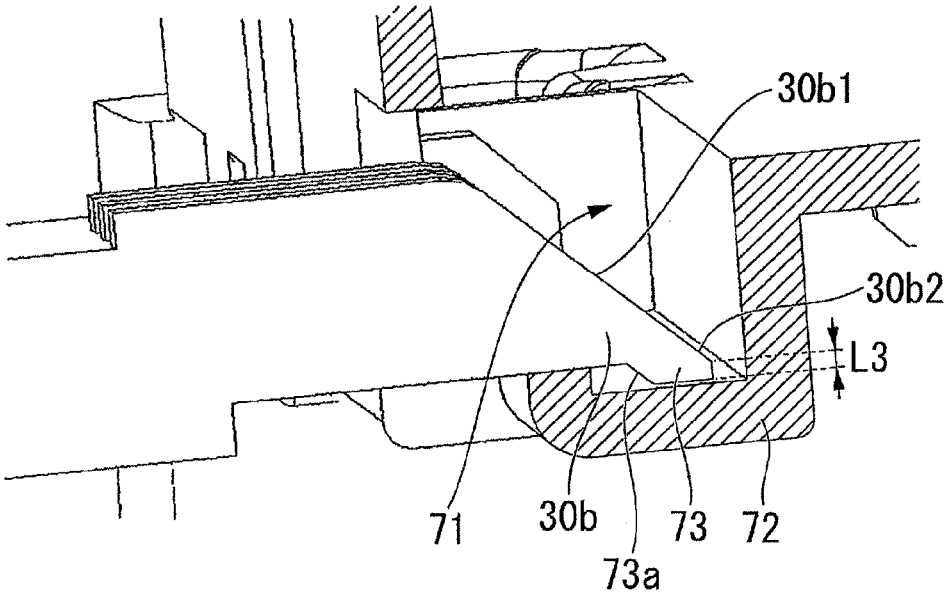
FIG. 19 is an enlarged perspective view of a configuration including a latching chip when a waste toner assembly is locked according to a copying machine applied with an image formation apparatus based on a second embodiment of the present disclosure.

FIG. 19 is an enlarged perspective view of a latching chip 30*b* according to the present embodiment. As shown in this diagram, according to the present embodiment, a click part 73 is provided on the tip 30*b*2 of the latching chip 30*b* so that the click part 73 protrudes toward the front side of the copying machine. This click part 73 is integrally provided with the latching chip 30*b* at a back surface side of the sloped surface 30*b*1 which is a contacting surface with the wall part 72. The amount of protrusion L3 (the length of protrusion toward the wall part 72 side in a locked condition) from the latching chip 30*b* of the clock part 73 is set, according to the latching chip 64*a*, to be greater than or equal to the difference between the distance L1 from the center of rotation O of the maximum external component 64*a* and the distance L2 from the center of rotation O to the tip 64*a*1. This configuration applies to the latching chip 64*b* in a similar manner as well.

According to such a click part 73, the amount of protrusion L3 from the latching chip 30*b* is set, according to the latching chip 64*a*, to be greater than or equal to the difference between the distance L1 from the center of rotation O of the maximum external component 64*a* and the distance L2 from the center of rotation O to the tip 64*a*1. This configuration applies to the latching chip 64*b* in a similar manner. Therefore, when the user tries to lock both the waste toner assembly 10 and the retainer main body 60 at once, it is possible to prevent the waste toner assembly 10 from becoming locked first. In other words, according to the present embodiment, the click part 73 acts to adjust the timing of locking at which the retainer main body 60 is locked before the waste toner assembly 10.

According to a copying machine based on the present embodiment, when the waste toner assembly 10 returns to a locked condition, the retainer main body 60 is also returned to a locked condition. Therefore, the retainer main body 60 may be returned to a locked condition in a reliable manner.

Figure 20A:
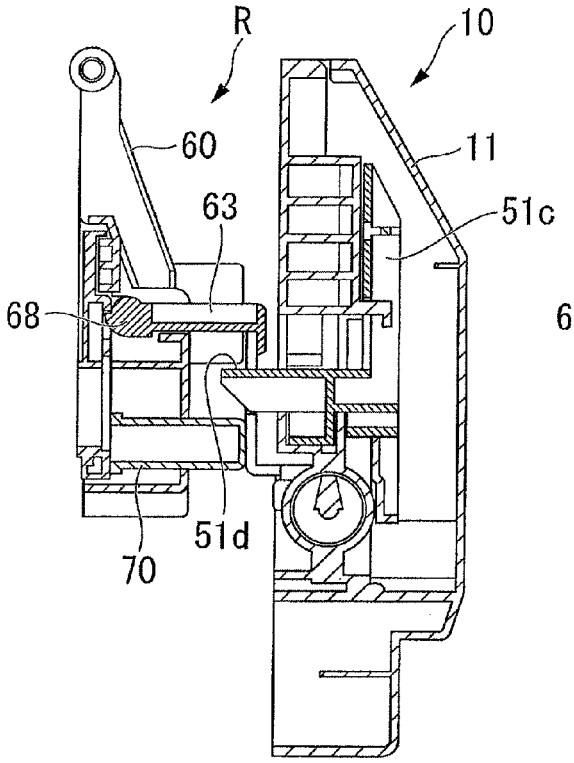
FIG. 20 is a cross sectional view of a configuration including a retainer and a waste toner assembly according to a copying machine applied with an image formation apparatus based on a second embodiment of the present disclosure.
Figure 20B:
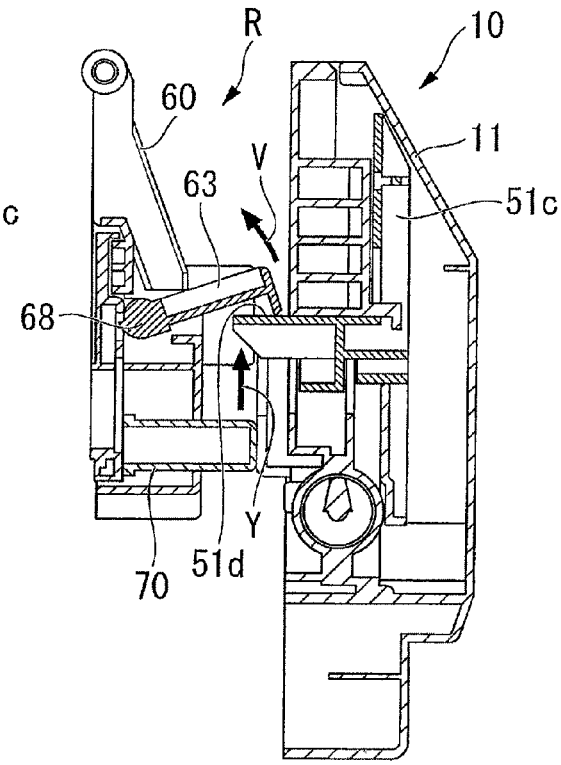

Further, according to a copying machine based on the present embodiment, the retainer main body 60 may be returned to a locked condition reliably by the click part 73. Therefore, as shown in FIG. 20, the pushing part 70 described in the first embodiment does not include a coil spring 70*a* and is instead fixed. When the pushing part 70 has a coil spring 70*a*, a biasing force is constantly applied to the waste toner assembly 10 in a locked condition. According to the present embodiment, there is no biasing force applying to the waste toner assembly 10 that is in a locked condition. Therefore, the load on the waste toner assembly 10 is reduced. Thus, it is possible to prevent any temporal change associated with the waste toner assembly 10.

Next, a third embodiment is described. In the following description, configurations that are similar to the first embodiment described above are explained in a simplified manner or not explained at all.

Figure 21A:
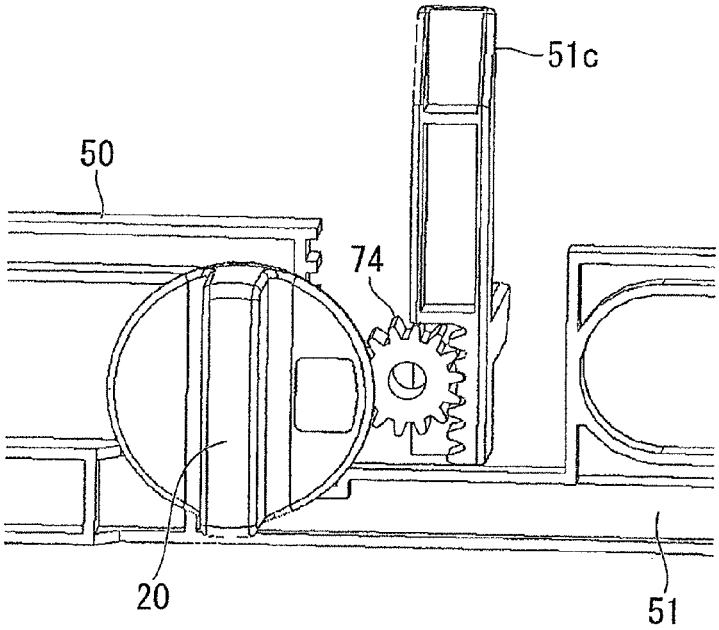
FIG. 21 is an enlarged perspective view of a configuration including a release lever according to a copying machine applied with an image formation apparatus based on a third embodiment of the present disclosure.
Figure 21B:
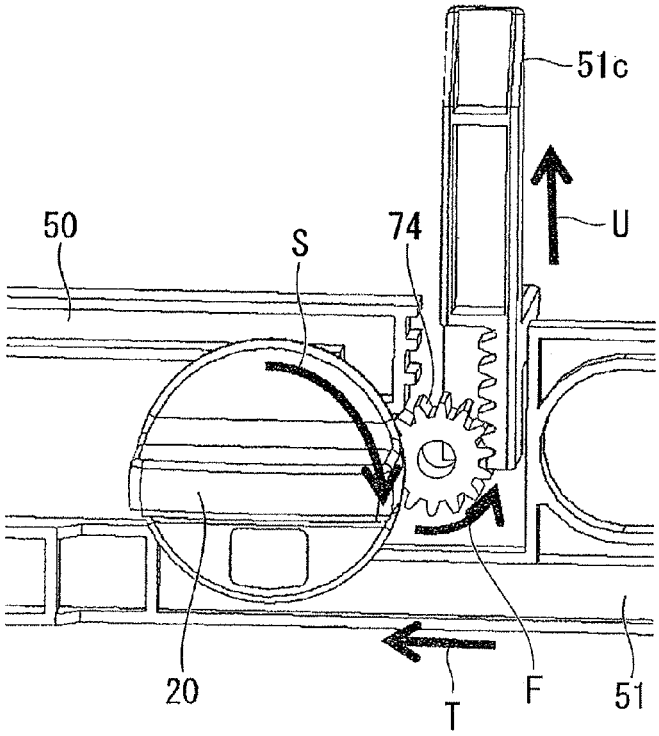

FIGS. 21A and 21B are enlarged frontal diagrams of a configuration adjacent to a release lever 20 based on the present embodiment. As shown in FIG. 21A, the copying machine according to the present embodiment comprises a gear wheel 74 which is in gear with the release lever 20 and the retainer lever releasing part 51*c*. Further, the sloped surface 51*b* is not provided to the connection rod 51. The connection rod 51 and the retainer release part 51*c* are not in contact with one another and are instead distanced from one another. In other words, according to the present embodiment, the connection rods 50, 51 (the first transmission part) and the retainer release part 51*c* (the second transmission part) are placed so as to be distanced from one another. The connection rods 50, 51 transmit the power due to the rotation of the release lever 20 to the latching chips 30*a*, 30*b*. The retainer release part 51*c* transmits power due to the rotation of the release lever 20 to the latching chips 64*a*, 64*b*.

Incidentally, the release lever 20 includes a click part at a back surface side, which is latched to the connection rod 51 and the connection rod 50 only when a rotation is made in the direction of the arrow S. This configuration applies in a similar manner in the embodiments described above. The click part is not diagrammed. When the connection rod 51 moves toward the right side in FIG. 21A due to an external force, the click part is not latched to the connection rod 51. When the connection rod 50 moves toward the left side in FIG. 21A due to an external force, the click part is not latched to the connection rod 50. Therefore, when the connection rods 50, 51 are moved due to an external force, the release lever 20 is not rotated.

Further, the release lever 20 is constantly biased toward an opposite direction with respect to the arrow S by a spring that is not diagrammed so that the release lever 20 returns to its original posture on its own.

According to a copying machine based on the present embodiment employing the above configurations, the release lever 20 is rotated in the direction of the arrow S. As a result, as shown in FIG. 21B, the gear wheel 74 rotates in a direction of the arrow F, and the retainer lever releasing part 51*c* moves upward via the gear wheel 74.

Meanwhile, when the waste toner assembly 10 that has been unlocked is returned to a locked condition, the connection rods 50, 51 move so that the latching chips 30*a*, 30*b* are pushed in. However, the connection rod 50, 51 and the retainer releasing part 51*c* are distanced. Therefore, the retainer release part 51*c* does not move upwards. Therefore, the retainer main body 60 will not act as a resistance to the pushing-in movement of the latching chips 30*a*, 30*b*. Thus, it is possible to reduce the load when the waste toner assembly 10 is returned to a locked condition.

Figure 22A:
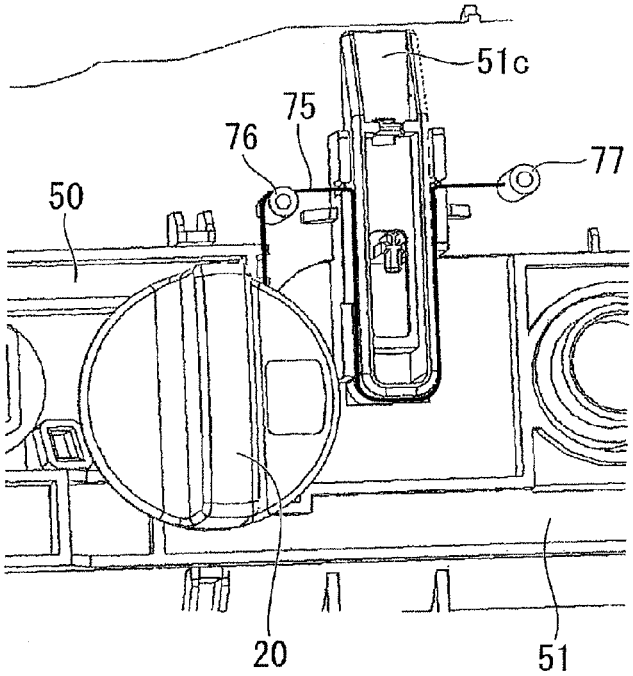
FIG. 22 is an enlarged perspective view of a configuration including a release lever according to a variation of a copying machine applied with an image formation apparatus based on a third embodiment of the present disclosure.

Further, as shown in FIG. 22A, a wire 75 may be provided instead of the gear wheel 74. Incidentally, in FIG. 22A, the wire 75 is emphasized to enhance visibility. An end of the wire 75 is connected to the release lever 20. The wire 75 is configured so that the wire 75 is rolled up by the release lever 20 as the release lever 20 rotates. Further, protrusion parts 76, 77 are provided at an inner wall of the cover body 11 flanking the retainer release part 51*c*. The wire 75 is rolled up to the protrusion part 76 provided at a release lever 20 side from above, while the other end is fixed to the protrusion part 77 provided at an opposite side with respect to the release lever 20. Further, between the protrusion part 76 and the protrusion part 77, the wire 75 is placed so as to contact the bottom part of the retainer release part 51*c*.

Figure 22B:
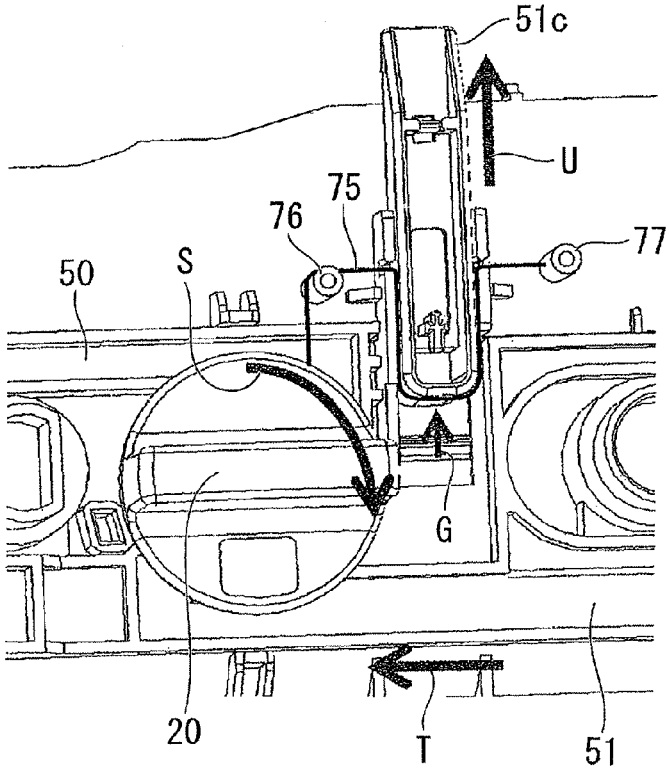

When such a wire 75 is provided, as shown in FIG. 22B, the wire 75 is rolled up by the release lever 20 by the release lever 20 being rotated in the direction of the arrow S. Therefore, as shown in the arrow G, the portion of the wire 75 which contacts the retainer release part 51*c* is elevated. As a result, the retainer lever release part 51*c* moves upwards.

When such a configuration is applied, the connection rods 50, 51 are distanced from the retainer release part 51*c*. Therefore, the retainer main body 60 will not act as a resistance to the pushing-in movement of the latching chip 30*a*, 30*b*. Therefore, it is possible to reduce the load when the waste toner assembly 10 is returned to a locked condition.

While a preferred embodiment of the present invention has been described above with reference to the attached figures, it should be noted that these are exemplary of the invention and are not to be considered as limiting the present invention. Additions, omissions, substitutions, and other modifications can be made without departing from the scope of the present invention.

For example, in the above example, the retainer lever 63 transmitted the movement of the release lever 20 using a releasing part 51*c* provided with a contacting surface 51*d*. However, the retainer lever 63 may directly contact the sloped surface 51*b* of the connecting rod 51.

Further, in the example described above, a waste toner assembly 10 and a retainer R corresponded to the opening-closing part. However, another component may be regarded as corresponding to the opening-closing part.

Further, in the example described above, a copying machine was regarded as an example of an image formation apparatus. However, a printer, a facsimile apparatus, and the like may be regarded as the image formation apparatus. It is also possible that the image formation apparatus refers to a multi purpose apparatus having the features of a copying machine, a printer, and a facsimile apparatus.

What is claimed is:

1. An image reproduction apparatus comprising:

an image formation part which is provided inside a main body and detachably attached to the main body;

a waste toner assembly which is movable from a closed position to an open position to allow for the detachment of the image formation part from the main body, and comprises a transport part transporting a waste toner generated by the image formation part to a waste toner bottle;

a retainer which is movable from a closed position to an open position to allow for detachment of the image formation part, and holds the image formation part;

a first locking part associated with the waste toner assembly which is provided at the waste toner assembly and latches the waste toner assembly to the main body;

a second locking part associated with the retainer which is provided at the retainer and latches the retainer to the main body; and a release lever which is rotatable and provided at the waste toner assembly, wherein when the release lever is repositioned, the first locking part of the waste toner assembly, and the second locking part of the retainer are simultaneously unlatched;

and wherein the first locking part of the waste toner assembly and the second locking part of the retainer are released by a rotation of the release lever;

a locking timing adjusting part which is provided at the waste toner assembly and the retainer and performs an adjustment so that, when the waste toner assembly and the retainer are returned to a latched condition from an unlatched condition, a timing at which the retainer is latched is earlier than a timing at which the waste toner assembly is latched.

2. The image reproduction apparatus according to claim 1, wherein the waste toner assembly is supported on the main body by a supporting axis provided at a lower end of the waste toner assembly, whereby the waste toner assembly may move relative to the main body from a closed position to an open position, and from an open position to a closed position;

the retainer is supported on the main body by a supporting axis provided at an upper end of the retainer, whereby the retainer may move relative to the main body from a closed position to an open position and from an open position to a closed position;

when the waste toner assembly and the retainer are in the closed position, an upper end of the waste toner assembly is positioned at a front of the retainer to span over at least a part of a front of the retainer; and when the waste toner assembly and the retainer are in the closed position, the release lever is positioned opposite the front of the retainer.

3. An image reproduction apparatus comprising:

an image formation part which is provided inside a main body and detachably attached to the main body;

a waste toner assembly which is movable from a closed position to an open position to allow for the detachment of the image formation part from the main body, and comprises a transport part transporting a waste toner generated by the image formation part to a waste toner bottle;

a retainer which is movable from a closed position to an open position to allow for detachment of the image formation part, and holds the image formation part;

a first locking part associated with the waste toner assembly which is provided at the waste toner assembly and latches the waste toner assembly to the main body;

a second locking part associated with the retainer which is provided at the retainer and latches the retainer to the main body; and a release lever which is rotatable and provided at the waste toner assembly, wherein when the release lever is repositioned, the first locking part of the waste toner assembly, and the second locking part of the retainer are simultaneously unlatched;

and wherein the first locking part of the waste toner assembly and the second locking part of the retainer are released by a rotation of the release lever; and a locking timing adjusting part which comprises, a first transmission part transmitting to the first locking part of the waste toner assembly, a power generated by a rotation of the release lever; and a second transmission part transmitting to the second locking part of the retainer, a power generated by a rotation of the release lever, wherein the first transmission part is distanced from the second transmission part.

4. The image reproduction apparatus according to claim 3, wherein the waste toner assembly is supported on the main body by a supporting axis provided at a lower end of the waste toner assembly, whereby the waste toner assembly may move relative to the main body from a closed position to an open position, and from an open position to a closed position;

the retainer is supported on the main body by a supporting axis provided at an upper end of the retainer, whereby the retainer may move relative to the main body from a closed position to an open position and from an open position to a closed position;

when the waste toner assembly and the retainer are in the closed position, an upper end of the waste toner assembly is positioned at a front of the retainer to span over at least a part of a front of the retainer; and when the waste toner assembly and the retainer are in the closed position, the release lever is positioned opposite the front of the retainer.

5. An image reproduction apparatus comprising:

an image formation part which is provided inside a main body and detachably attached to the main body;

a waste toner assembly which is movable from a closed position to an open position to allow for the detachment of the image formation part from the main body, and comprises a transport part transporting a waste toner generated by the image formation part to a waste toner bottle;

a retainer which is movable from a closed position to an open position to allow for detachment of the image formation part, and holds the image formation part;

a first locking part associated with the waste toner assembly which is provided at the waste toner assembly and latches the waste toner assembly to the main body;

a second locking part associated with the retainer which is provided at the retainer and latches the retainer to the main body; and a release lever which is rotatable and provided at the waste toner assembly, wherein when the release lever is repositioned, the first locking part of the waste toner assembly, and the second locking part of the retainer are simultaneously unlatched, wherein the transport part comprises a transport pipe and a screw conveyer comprising a spiral blade rotated and driven around an axis of the spiral blade inside the transport pipe, and the waste toner bottle is attached below the transport pipe; and wherein the transport pipe extends approximately in a horizontal direction inside of the waste toner assembly, and the waste toner assembly is provided so that the waste toner assembly rotates in an upper and lower direction around a supporting axis which is provided at a lower end of the waste toner assembly, the supporting axis being parallel to an axis of the transport pipe and being provided below the axis of the transport pipe by a predetermined distance.

6. The image reproduction apparatus according to claim 5, wherein the waste toner bottle is configured to be attached to the main body and detached from the main body; and when the waste toner bottle is attached to the main body, the release lever is restricted from unlatching one of the locking parts.

7. The image reproduction apparatus according to claim 5, wherein the transport pipe extends approximately in a horizontal direction, and the waste toner assembly is provided so that the waste toner assembly may rotate in an upper and lower direction around the supporting axis of the waste toner assembly, the supporting axis of the waste toner assembly being parallel to an axis of the transport pipe and being provided below the axis of the transport pipe by a predetermined distance.

8. The image reproduction apparatus according to claim 5, wherein the waste toner assembly is supported on the main body by a supporting axis provided at a lower end of the waste toner assembly, whereby the waste toner assembly may move relative to the main body from a closed position to an open position, and from an open position to a closed position;

the retainer is supported on the main body by a supporting axis provided at an upper end of the retainer, whereby the retainer may move relative to the main body from a closed position to an open position and from an open position to a closed position;

when the waste toner assembly and the retainer are in the closed position, an upper end of the waste toner assembly is positioned at a front of the retainer to span over at least a part of a front of the retainer; and when the waste toner assembly and the retainer are in the closed position, the release lever is positioned opposite the front of the retainer.

* * * * *